United States Patent [19]

Cha

[11] 4,263,970

[45] * Apr. 28, 1981

[54] METHOD FOR ASSURING UNIFORM COMBUSTION IN AN IN SITU OIL SHALE RETORT

[75] Inventor: Chang Y. Cha, Bakersfield, Calif.

[73] Assignee: Occidental Oil Shale, Inc., Grand Junction, Colo.

[ * ] Notice: The portion of the term of this patent subsequent to Aug. 8, 1995, has been disclaimed.

[21] Appl. No.: 929,447

[22] Filed: Jul. 31, 1978

Related U.S. Application Data

[63] Continuation-in-part of Ser. No. 839,010, Oct. 3, 1977, abandoned, which is a continuation-in-part of Ser. No. 772,760, Feb. 28, 1977, abandoned, which is a continuation of Ser. No. 651,800, Jan. 23, 1976, abandoned, which is a continuation of Ser. No. 536,771, Dec. 26, 1974, abandoned, and a continuation-in-part of Ser. No. 763,155, Jan. 27, 1977, Pat. No. 4,105,072, which is a continuation-in-part of Ser. No. 748,622, Nov. 29, 1976, abandoned, which is a continuation of Ser. No. 652,335, Jan. 26, 1976, abandoned, which is a continuation of Ser. No. 504,028, Sep. 9, 1974, abandoned, said Ser. No. 763,155, is a continuation-in-part of Ser. No. 622,653, Oct. 16, 1975, Pat. No. 4,005,752, which is a continuation of Ser. No. 492,253, Jul. 26, 1974, abandoned.

[51] Int. Cl.[2] ..... E21B 43/243; E21C 41/10

[52] U.S. Cl. ..... 166/261; 166/259; 299/2; 208/11 R

[58] Field of Search ..... 299/2; 166/256–262

[56] References Cited

U.S. PATENT DOCUMENTS

| | | | |
|---|---|---|---|
| 1,919,636 | 7/1933 | Karrick | 299/2 |
| 2,481,051 | 9/1949 | Uren | 299/2 |
| 2,780,449 | 2/1957 | Fisher et al. | 166/259 |
| 3,001,775 | 9/1961 | Allred | 166/257 |
| 3,346,044 | 10/1967 | Slusser | 166/259 X |
| 3,362,471 | 1/1968 | Slusser et al. | 166/251 |
| 3,400,762 | 9/1968 | Peacock et al. | 166/259 |
| 3,460,620 | 8/1969 | Parker | 166/247 X |
| 3,499,489 | 3/1970 | Parker | 166/258 |
| 3,548,938 | 12/1970 | Parker | 166/256 |
| 3,586,377 | 6/1971 | Ellington | 299/4 |
| 3,596,993 | 8/1971 | Busey | 166/257 |
| 3,601,193 | 8/1971 | Grady | 166/259 |
| 3,882,941 | 5/1975 | Pelofsky | 166/263 X |
| 3,994,343 | 11/1976 | Cha et al. | 166/259 |
| 4,105,072 | 8/1978 | Cha | 299/2 |

*Primary Examiner*—Ernest R. Purser

*Attorney, Agent, or Firm*—Christie, Parker & Hale

[57] ABSTRACT

A substantially flat combustion zone is established in a fragmented mass of particles containing oil shale in an in situ oil shale retort. By igniting a portion of the mass of particles, a heated zone including a combustion zone is established in the retort. For a first period of time, an oxidizing gas is introduced into the retort and heated zone at a rate sufficient to advance the heated zone through the fragmented mass. The locus of the combustion zone is monitored to determine if the combustion zone is substantially flat. If the combustion zone is not substantially flat, introduction of oxidizing gas into the retort is reduced temporarily for a second period of time to a rate such that the flow of heated gas through the retort for retorting oil shale in a retorting zone on the advancing side of the combustion zone is substantially reduced for a sufficient time to appreciably flatten the heated zone. Thereafter, introduction of gas comprising an oxidizing gas to the retort is resumed at a sufficient rate to advance the heated zone through the fragmented mass.

Off gas withdrawn from the retort during the second period of time can be enriched having a heating value of at least about 75 BTU/SCF, and often in excess of about 150 BTU/SCF. To produce such enriched off gas, introduction of gas into the retort can be temporarily reduced even when it is not necessary to establish a substantially flat combustion zone in the retort. This enriched off gas can be withdrawn from the top of the retort and can be used for igniting another retort or for sustaining a secondary combustion zone in another retort.

104 Claims, 4 Drawing Figures

AIR
GAS
10
11
12
13
14
18
19
21
22
23
24

AIR
GAS
10
11
12
13
14
16
17

METHOD FOR ASSURING UNIFORM COMBUSTION IN AN IN SITU OIL SHALE RETORT

CROSS REFERENCES

This application is a continuation-in-part of U.S. patent application Ser. No. 839,010 filed on Oct. 3, 1977, now abandoned which is a continuation-in-part of U.S. patent application Ser. No. 772,760 filed on Feb. 28, 1977, now abandoned, which is a continuation of U.S. patent application Ser. No. 651,800 filed on Jan. 23, 1976, now abandoned, which is a continuation of application Ser. No. 536,371 filed Dec. 26, 1974, and now abandoned.

This application is also a continuation-in-part of application Ser. No. 763,155 filed on Jan. 27, 1977, now U.S. Pat. No. 4,105,072, which is a continuation-in-part of patent application Ser. No. 748,622 filed Nov. 29, 1976, now abandoned, which is a continuation of patent application Ser. No. 652,335 filed on Jan. 26, 1976, now abandoned, which is a continuation of patent application Ser. No. 504,028 filed Sept. 9, 1974 now abandoned. Application Ser. No. 763,155 is also a continuation-in-part of application Ser. No. 622,653 filed Oct. 16, 1975, now U.S. Pat. No. 4,005,752, which is a continuation of application Ser. No. 492,253 filed July 26, 1974 now abandoned.

The subject matter of each of these ten patent applications is incorporated herein by this reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising maristone deposit with layers containing an organic polymer called "kerogen", which upon heating decomposes to produce liquid and gaseous hydrocarbon products. It is the formation containing kerogen that is called "oil shale" herein, and the liquid hydrocarbon product is called "shale oil".

A number of methods have been proposed for processing oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale after kerogen decomposition contains substantial amounts of residual carbonaceous material which can be burned to supply heat for retorting.

The recovery of liquid and gaseous products from oil shale deposits has been described in several patents, one of which is U.S. Pat. No. 3,661,423 issued May 9, 1972, to Donald E. Garrett, assigned to the assignee of this application and incorporated herein by reference. This patent describes in situ recovery of liquid and gaseous hydrocarbon materials from a subterranean formation containing oil shale by fragmenting such formation to form a cavity containing a stationary, fragmented permeable body or mass of formation particles containing oil shale within the formation, referred to herein as an in situ oil shale retort. The cavity has bottom, top, and side boundaries of unfragmented formation. Hot retorting gases are passed through the in situ oil shale retort to convert kerogen contained in the oil shale to liquid and gaseous products, thereby producing "retorted oil shale".

One method of supplying hot retorting gases used for converting kerogen contained in the oil shale, as described in U.S. Pat. No. 3,661,423, includes establishment of a heated zone such as a combustion zone and/or a retorting zone in the retort and introduction of an oxygen containing inlet gas such as air into the combustion zone to advance the combustion zone through the fragmented mass in the retort. The combustion zone can be established in the fragmented mass by burning a hydrocarbon containing gas, liquid and/or solid in the presence of air. In the combustion zone, oxygen in the inlet processing gas is depleted by reaction with hot residual carbonaceous materials to produce spent or dekerogenated oil shale and heat. By the continued introduction of the oxygen containing inlet gas into the combustion zone, the combustion zone is advanced through the retort.

Hot effluent gas from the combustion zone passes through the retort on the advancing side of the combustion zone to heat oil shale in a retorting zone in the fragmented mass to a temperature sufficient to produce thermal decomposition of kerogen, called retorting, in the oil shale to gaseous and liquid products and a residual product of solid carbonaceous material. Heat of combustion is carried from the combustion zone to the retorting zone largely by gas flow. Thermal decomposition of kerogen in the oil shale proceeds at about 800° F., and appreciable quantities of carbonaceous materials are driven off from the oil shale at even lower temperatures. It will be recognized that the rate of progression of the combustion zone is quite slow and is ordinarily in the order of only a few feet per day. The combustion zone is not a thin layer but ordinarily has appreciable thickness due to gradual consumption of oxygen in the downwardly flowing gas and inherent variations in particle size of the oil shale. The combustion zone is the portion of the retort where the greater part of the oxygen in the combustion feed that reacts with residual carbonaceous material in retorted oil shale is consumed.

It is found that the best yield of shale oil from oil shale is obtained when the combustion zone moves downwardly through the retort as a substantially flat horizontal zone. If all or part of the combustion zone is skewed from the horizontal and/or warped, there is some tendency for it to approach the horizontal, but this is slow and the combustion zone may progress a substantial distance through the retort before this occurs. When the combustion zone is skewed some of the shale oil produced may be burned, thereby reducing the total yield. In addition, with a skewed and/or warped combustion zone, excessive cracking of hydrocarbon products produced in the retorting zone can result. It is, therefore, desirable to have the combustion zone progress downwardly through the retort as a substantially flat horizontal wave.

Establishment of a combustion zone in the retort can be effected according to the method described in U.S. Pat. No. 3,990,835, issued Nov. 9, 1976, and U.S. Pat.

No. 3,952,801 issued Apr. 27, 1976, both of which were issued to Robert S. Burton III and assigned to the assignee of this application. Both of these patents are incorporated herein by this reference. The '801 patent describes a technique for establishing a combustion zone in a retort by igniting the top of a fragmented permeable mass in the retort. According to this technique, a hole is bored to the top of the fragmented permeable mass and a burner is lowered through the bore hole to the oil shale to be ignited. A mixture of a combustible fuel such as LPG (liquefied petroleum gas) and gas containing oxgyen, such as air, is burned in the burner and the resultant flame is directed downwardly towards the fragmented permeable mass. The burning is conducted until a substantial portion of the oil shale has been heated above the self-ignition temperature of carbonaceous material in the oil shale so combustion of oil shale in the fragmented mass is self-sustaining. Then introduction of fuel is terminated, the burner is withdrawn from the retort through the hole, and oxygen supplying gas is introduced to the retort to advance the combustion zone through the retort.

An in situ oil shale retort may have a substantial lateral extent; for example, it may be square with a width of 100 ft. or more. Ignition of the top of the rubble pile in a completely filled retort requires access which is ordinarily obtained by forming a conduit through the overlying unfragmented rock. In a relatively smaller retort a single central conduit may be used. In a larger retort a number of conduits to various top portions of the retort may be preferred. These conduits supply combustion air or other oxidizing gas during normal operation of the retort and their openings into the retort are also used to locate points of ignition for establishing a combustion zone. Since the ignition points are isolated, the top of the retort is inherently nonuniformly ignited.

For purposes of exposition a single ignition point in the center of a retort can be assumed. A retort with a number of separate ignition points can be considered as a plurality of adjacent smaller retorts, each with a single ignition point. Ignition is obtained by burning a combustible gas with air or other oxygen supplying gas and impinging the flame on the top of the rubble pile at the opening of the conduit. This heating may be conducted for a substantial period of time so that a sufficient volume of rock is heated to sustain combustion after the initial burning is stopped and air or the like is forced down the conduit. The combustion zone that is formed around the ignition point tends to progress downwardly and outwardly. It is driven downwardly by the gas flowing through the retort and progresses laterally primarily by conduction and radiation which are much slower. Substantial unburned portions may be left in the upper "corners" or side edges of the retort. Self-ignition temperature of the carbonaceous material in oil shale can vary with various conditions such as total gas pressure and the partial pressure of oxygen in the retort, and may be as low as 500° F., although 750° F. is usually considered a minimum. In operation of an in situ retort it is preferred to consider 900° F. as the self-ignition temperature. Temperatures in the combustion zone of a retort may be 1200° F. or more.

Since nonuniform ignition results in a nonhorizontal and non-planar combustion zone travelling through the retort, it is desirable to provide a technique for establishing and maintaining a combustion zone in an in situ oil shale retort where the combustion zone is flat and uniformly transverse to its direction of advancement and extends laterally to the boundaries of the retort.

The combustion and retorting zones are advanced through the fragmented permeable mass in the retort until near or at the end of the fragmented mass. Cooling by cold gas or air introduced into the retort on the trailing side of the combustion zone forms a cooling zone on the trailing side of the combustion zone. Cooling below the ignition temperature and depletion of carbonaceous material in spent shale on the trailing side of the combustion zone can cause discontinuance of combustion on the trailing side of the combustion zone. As used herein, the term "heated zone" refers to a hot portion of the fragmented mass such as a combustion zone and/or a retorting zone. Further, as retorting proceeds, a substantial portion of shale on the trailing side of the combustion zone can be hot enough to effect retorting of oil shale. This portion which has not been cooled by inlet gas can be part of the heated zone. The heated zone is regarded as that region at a temperature above the retorting temperature of oil shale.

The liquid products and gaseous products of kerogen decomposition are cooled by the cooler oil shale particles in the retort on the advancing side of the retorting zone. A liquid product stream is collected at the bottom of the retort and withdrawn to the surface of the ground through an access tunnel, drift, or shaft. The liquid product stream includes shale oil and water. An off gas containing combustion gas generated in the combustion zone, gaseous products produced in the retorting zone, including hydrocarbons and hydrogen, gas from carbonate decomposition, and the portion of inlet gas that does not take part in the combustion process is also collected at the bottom of the retort and withdrawn to the surface. Such off gas is generally lean, having a relatively low heating value of from about 20 to 100 BTU/SCF and often in the order of about 50 BTU/SCF. The heating value of such off gas from normal retorting operation can be too low for the off gas to be used alone as a fuel gas for establishment of a primary combustion zone or a secondary combustion zone in an in situ oil shale retort. An enrichment operation is, therefore, provided in practice of this invention for producing off gas of enhanced heating value.

In the above-described process, a portion of the fragmented mass can be left unretorted. This can result from gas flow maldistribution through the retort such as channeling of gas flow through the fragmented permeable mass of formation particles in the retort and non-uniform and uneven gas flow through the retort due to non-uniform or uneven void fraction and particle size distribution in the retort. Uneven distribution of void fraction and particle size can occur in an in situ retort because of variations in the blasting technique employed and the amount of explosive used in preparing the in situ retort, as well as physical properties of the formation containing oil shale. Because of such gas flow maldistribution, the front of the retorting zone can be non-uniform. Thus, even when normal retorting is completed, some of the fragmented mass in a portion of the retort can remain unretorted.

Another source of unretorted oil shale in the tract being developed by in situ retorting is formation left unfragmented to function as pillars between in situ retorts. Such pillars can support overburden and serve as barriers to substantial gas flow between fragemented masses in adjacent retorts. The portion of the formation left as pillars can be a significant proportion of the entire formation and can be, for example, approximately 30% of the entire formation in a tract being treated by means of an in situ retorting process. Since the formation present in such pillars has low permeability and low thermal diffusivity, the rate of retorting oil shale in the pillars is slower than in the fragmented permeable mass of formation particles in the retort. Hence, oil shale in the pillars can be left unretorted at the end of normal retorting operation.

Thus, it is desirable to increase the yield or recovery of hydrocarbons from an in situ oil shale retort by recovering carbonaceous values from unretorted oil shale remaining in pillars adjacent the fragmented mass in the retort and from portions of the mass of formation particles containing unretorted oil shale in the retort.

As used herein, normal retorting operation refers to retorting of oil shale in a fragmented permeable mass in an in situ oil shale retort by advancing a heated retorting zone therethrough, with transfer of heat through the fragmented permeable mass being primarily by means of gas flow. Exemplary of the rate of normal retorting operation is an advance of a retorting zone between about one and two feet per day. In one example a retorting zone advances through about 270 feet of fragmented permeable mass in about 165 days of retorting.

As used herein, enrichment operation refers to a period during which there is little, if any, advancement of the retorting zone. As noted hereafter, during an enrichment operation, heat transfer by conduction and radiation are important.

SUMMARY OF THE INVENTION

According to this invention a substantially flat combustion zone is established in a fragmented permeable mass of particles containing oil shale in an in situ oil shale retort by igniting a portion of the mass of particles, thereby establishing a heated zone including a combustion zone in the retort. For a first period of time, a gas including an oxidizing gas is introduced into the retort and heated zone at a rate sufficient to effect advancement of the heated zone through the fragmented mass and to effect flow of heated gas through the retort on the advancing side of the combustion zone for retorting oil shale in a retorting zone on the advancing side of the combustion zone. For a second period of time, introduction of gas into the retort is reduced to a rate such that the flow of heated gas through the retort is substantially reduced for a sufficient time to appreciably flatten the heated zone. When reducing the rate of introduction of gas, introduction of gas into the heated zone can be completely stopped. Thereafter, introduction of gas including an oxidizing gas is resumed into the retort and the heated zone at a rate sufficient to effect advancement of the heated zone through the fragmented mass.

To maintain the combustion zone substantially uniformly flat, the locus of the combustion zone can be monitored to determine if the combustion zone is substantially flat. If the combustion zone is not substantially flat, the steps of introducing gas into the retort at a reduced rate and thereafter resuming introduction of a gas including an oxidizing gas into the retort at a rate sufficient to effect advancement of the heated zone through the fragmented mass can be repeated.

It has been determined that during the second period of time, an off gas of enhanced heating value, referred to herein as "enriched off gas", can be generated. Accordingly, there is also provided according to the present invention, a process for recovering enriched off gas from an in situ oil shale retort in a subterranean formation containing oil shale, the retort containing a fragmented permeable mass of formation particles containing oil shale. According to this process, a heated zone, which does not necessarily include a combustion zone, is established in the fragmented mass. For a first period of normal retorting operation a processing gas is introduced to the fragmented mass on the trailing side of the heated zone at a sufficient rate for advancing the heated zone through the fragmented mass. During this period of normal retorting operation liquid products and off gas containing gaseous products are withdrawn from the retort on an advancing side of the heated zone. For the second period of time, referred to herein as the enrichment operation, introduction of gas into the fragmented mass is reduced and off gas including gaseous products from retorting oil shale is withdrawn from the retort. The rate of gas introduction is sufficiently reduced that the withdrawn off gas has a heating value of at least about 75 BTU/SCF. Preferably the heating value is at least about 150 BTU/SCF.

During the enrichment operation, the introduction of gas to the retort can be substantially completely stopped. This can be effected by closing an inlet to the retort. Also during the enrichment operation, relatively rich off gas is preferably withdrawn from the retort at a sufficient rate to prevent pressure buildup inside the retort, and can be withdrawn from the retort at a rate sufficient to reduce the pressure in the retort to less than ambient pressure in adjacent underground workings.

Enriched off gas produced during enrichment operation of a first retort can be used for establishing and/or maintaining a secondary combustion zone in a second in situ oil shale retort or for establishing a heated zone such as a combustion zone in a second in situ oil shale retort. This is effected by burning the enriched off gas with an oxygen containing gas at the second retort.

After completion of the enrichment operation and before resumption of introduction of processing gas to the retort, it is preferred that a purging gas substantially free of free oxygen be introduced to the retort to avoid the possibility of an explosion due to introduction of an oxygen containing gas into a retort full of flammable hydrocarbon gases.

DRAWINGS

These and other features, aspects and advantages of the present invention will become more apparent when considered with respect to the following description, appended claims and accompanying drawings where:

DESCRIPTION

Figure 1:
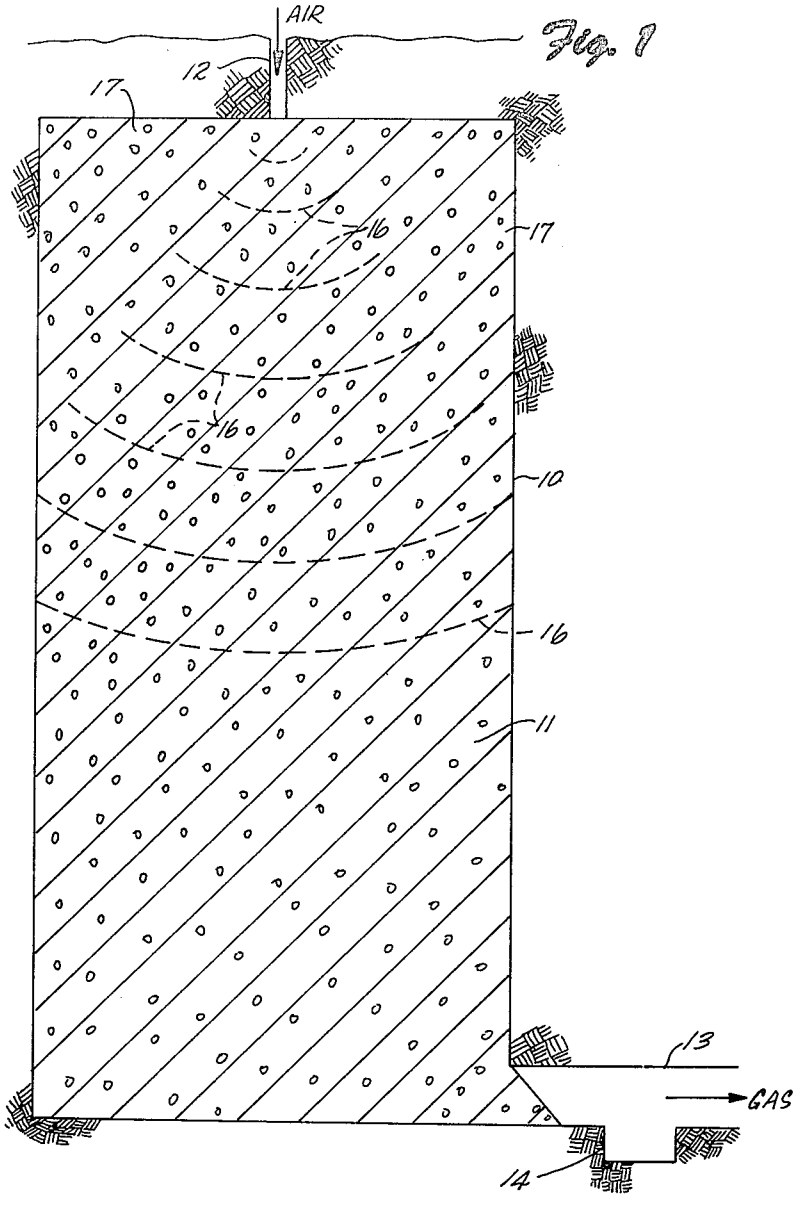
FIG. 1 illustrates semi-schematically in vertical cross section an in situ oil shale retort operated without practice of this invention.

As illustrated in FIG. 1, an in situ oil shale retort 10 is in the form of a room or cavity having side boundaries of unfragmented formation. The cavity can be completely filled with a rubble pile 11, i.e., a fragmented permeable mass of formation particles containing oil shale. One or more conduits 12 lead to the top of the rubble pile in the retort for introduction of a retort inlet mixture such as air or other oxidizing gas to support combustion. The conduit 12 can also be used for withdrawal of gas from the retort.

The fragmented permeable mass of particles has boundaries of unfragmented formation. The unfragmented formation is essentially intact without appreciable void volume and, if desired, can be fractured for enhanced permeability. Walls of unfragmented formation adjacent side boundaries of the fragmented permeable mass are somtimes referred to as pillars. Such pillars can contain substantial amounts of oil shale.

Ignition of the rubble pile in the retort occurs at the bottom of the conduit 12. A tunnel or drift 13 at the bottom is provided for withdrawal of off gas which includes the products of combustion of carbonaceous material in the oil shale, any gaseous nonreactive portion of the retort inlet mixture, and gaseous hydrocarbon products of retorting. The bottom of the retort can be closed, i.e., the tunnel 13 is blocked, and gas is removed through conduits in the tunnel. A sump 14 is provided for collecting liquid shale oil.

In a preferred embodiment, a heated zone is established in an upper portion of the fragmented mass in the in situ retort. The heated zone can be established by any of a variety of techniques, including an off gas burning technique as hereinafter described. The heated zone has a temperature above the ignition temperature of carbonaceous material in the oil shale when the heated zone includes a combustion zone.

After ignition, an oxygen containing gas introduced through the conduit 12 as a combustion zone feed moves downwardly through the retort and drives the combustion zone 16 downwardly. The oxygen containing gas can be air augmented with oxygen or air diluted with recycled off gas or steam. Other oxygen containing gas can also be used for establishing and sustaining a combustion zone in the fragmented mass. For convenience, the oxygen containing gas may be referred to herein as "air". As illustrated in FIG. 1, the combustion zone 16 is shown by dashed lines in a series of positions as it progresses downwardly through the retort. These dashed lines 16 represent the front or lower part of the combustion zone, which my have appreciable thickness. Heat from the combustion zone moves downwardly largely due to heat transfer by convection by the downwardly flowing gas through the retort. It also moves radially outwardly due to lateral heat transfer by conduction and radiation through the oil shale particles and the void space therebetween. There is some lateral flow of gas near the top of the retort which also helps carry heat laterally, but most heat flow is downwardly. As used herein, "heat transfer by convection" includes both heat transferred by movement of a gas arising naturally due to variation of its density and the action of gravity, and heat transferred by induced movement of a hot gas such as by a blower or fan.

For purposes of exposition the radiating pattern of the combustion zone might be considered as a spherical wave propagating from a point at the bottom of the conduit 12. The pattern is not in fact spherical since the downward and lateral heat transfer rates are not equal, but it is a convenient analogy. (In one actual retort the combustion zone initially extended as a sharp spike downwardly from the central ignition point with limited lateral spreading.) In any event, the combustion zone proceeds downwardly and outwardly through the fragmented mass in the retort with the upper edge of the region encountered by the combustion zone (i.e. the shale heated above the self-ignition temperature of carbonaceous material contained therein) being in essence a cone with its apex near the source of ignition. Thus the upper edges 17 in the retort may be bypassed by the combustion zone and the kerogen in the oil shale in these corners is effectively lost. This oil shale is either not retorted since the shale oil is not heated, or if it is eventually heated, it moves downwardly through the fragmented mass into a combustion zone lower down and is consumed, thereby reducing the overall yield from the retort.

Figure 2:
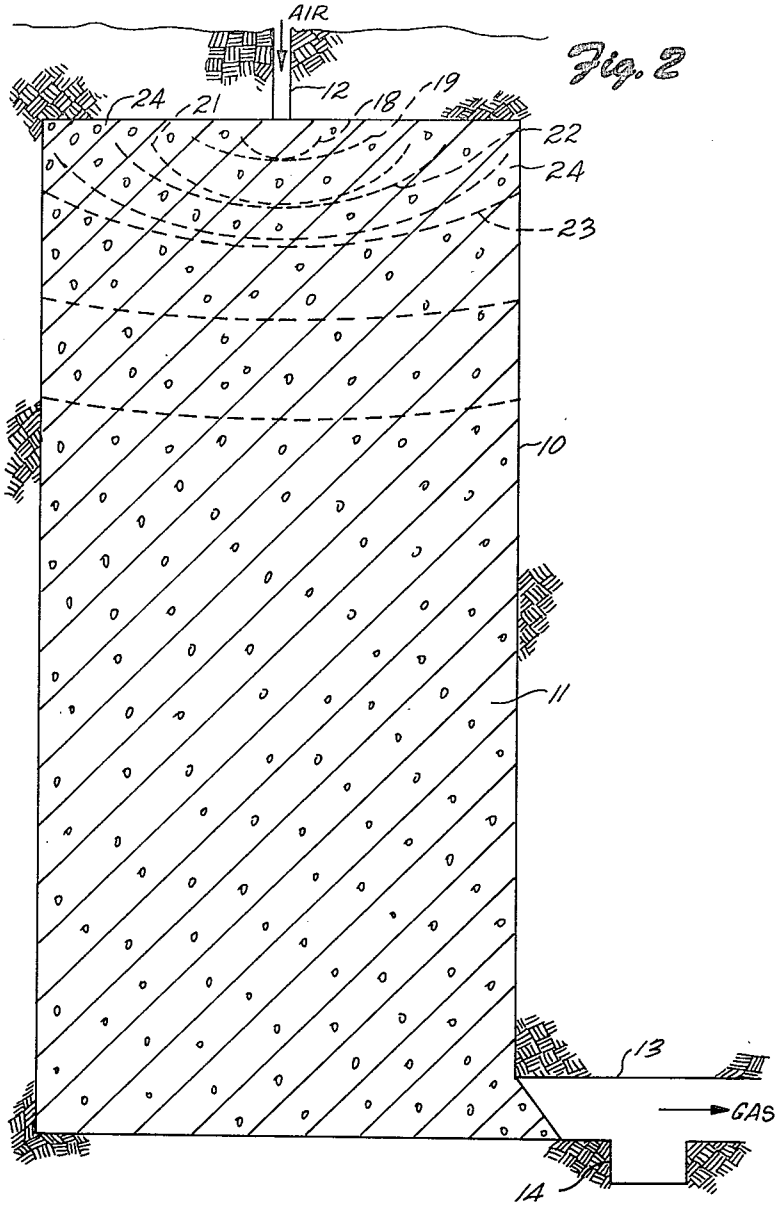
FIG. 2 illustrates a similar retort operated in accordance with practice of this invention.

Referring now to FIG. 2, the same reference numerals are applied for the structural elements of the retort, since structurally it is the same as that illustrated in FIG. 1. The differences lie in the mode of operation. Once the retort has been ignited and a substantial volume of the rock therein heated above the self-ignition temperature of the carbonaceous material in the oil shale, the supply of combustion zone feed through the conduit 12 is temporarily reduced or completely shut off. Assuming for the moment that downward gas flow through the retort is temporarily stopped, it is apparent that heat from a heated or hot zone diffuses toward the cooler portions of the retort.

As used herein, the term "heated zone" refers to a hot portion of the fragmented mass such as a combustion zone and/or a retorting zone. As used herein, the term "retorting zone" refers to the portion of the retort where kerogen in oil shale is being decomposed to liquid and gaseous products. As used herein, the term "combustion zone" refers to the portion of the retort where the greater part of the oxygen in the retort inlet mixture that reacts with the residual carbonaceous material in retorted oil shale is consumed.

The rubble pile of oil shale particles has a void volume or fraction between the particles, the magnitude of which depends on the technique used for forming the rubble pile. Void fraction is the ratio of the volume of the void or spaces between particles in the fragmented mass to the total volume of the fragmented permeable mass of particles in the in situ oil shale retort. Ordinarily, this void fraction can be in the range of about 15 to 30% of the total volume of the retort. This void fraction contains gas, and heat is therefore transferred by natural convection of this gas in and near the zone of hot rock. This natural convection due to density differences resulting from temperature differences tends to carry heat upwardly and to some extent laterally. Heat is also transferred laterally, as in all other directions, by conduction through the shale particles and by radiation. Gas generated in the hot part of the retort by thermal decomposition is removed, preferably from the bottom of the retort, to avoid increases in pressure. Shale oil also moves downwardly for eventual recovery. Gas can be removed from the top but this might require equipment modification. Small amounts of sensible heat may be carried downwardly by the gas generated in the hot zone. Much of this gas comes from thermal decomposition of inorganic carbonates in the shale and other comes from connate water, seepage water and decomposition of kerogen.

Thus, when the downward flow of air through the retort is shut off, the principle directions of heat flow are laterally and upwardly.

If, rather than completely shutting off the downward flow of oxidizing gas, the inlet flow is simply reduced to a minimum to reduce downward convection heat transfer, the major upward or downward heat transfer is by way of radiation and conduction. As a result, a substantial amount of heat is available for lateral transfer. There is continued generation of heat due to replenishment of oxygen in the heated zone of the retort and consequent burning of carbonaceous material. This heat is also available for spreading laterally.

Initially the operation of the retort after ignition is with oxidizing gas flow at a normal retorting rate so that a generally "spherical" combustion zone, the front or lower end of which is indicated by the dashed line 18, propagates from the bottom of the conduit in the same manner as hereinabove described. When a sufficient volume of rock has been heated above the self-ignition temperature of carbonaceous material contained therein, both in and above the combustion zone, the downward flow of oxidizing gas through the conduit is reduced to a minimum level or completely stopped so that downward convective heat transfer is less than or equivalent to conductive and radiative heat transfer.

The introduction of oxidizing gas into the combustion zone is reduced to a rate such that substantially no heat is tranferred by gas flow from the combustion zone to the retorting zone. Such rate is no more than about of the same order of magnitude as the rate of flow of gas generated in the retort due to thermal decomposition. This permits lateral heat transfer without significant advancement of the combustion zone. That is, introduction of oxidizing gas into the heated zone in the retort is reduced to a rate such that the rate of heat transfer by gas flow is no more than about the rate of conductive and radiative heat transfer.

The rate of introduction of oxidizing gas is reduced, or completely stopped, for a sufficient time to raise the temperature of lateral portions of the retort adjacent the heated zone above the self-ignition temperature of carbonaceous material in the oil shale. That is, there is a temporary reduction of introduction of gas into the retort for a sufficient time to establish an approximately horizontal and substantially flat heated zone, i.e., a heated zone which is planar and substantially transverse to its direction of advancement through the fragmented mass.

The heat in the zone in and above the combustion zone is transferred to a large extent laterally to form a zone indicated by the dashed line 19 in which the oil shale is heated above the self-ignition temperature of residual carbonaceous material contained therein. Since there is little, if any, downward heat transfer in the lowermost heated zones, the result is a substantial flattening of the heated zone that will support combustion when downward air flow is increased to a normal retorting rate. (For example, about 2 SCFM per square foot of retort area. Reduced flow can be essentially up to about 0.1 SCFM per square foot.)

This flattened heated zone which becomes the combustion zone when oxidizing gas flow is resumed can extend laterally clear to the side boundaries of the retort before the temperature in the center portions of the heated zone drops to a point too close to the minimum self-ignition temperature of the oil shale.

If this is not the case, the normal retorting rate of oxidizing gas flow can be resumed so that the new combustion zone propagates in the usual manner, largely influenced by the heat transfer due to downward flow of gas through the retort. This can move the combustion zone to a new location as indicated by the dashed line labelled 21 in FIG. 2 and substantially increase the volume of rock heated above the self-ignition temperature. Again, the downward flow of oxidizing gas can be reduced to a minimal level or cut off completely and substantial heat is transferred radially to form a combustion zone front as indicated by the dashed line 22 which is considerably flattened from the previous combustion zone. This process of temporarily reducing or stopping the oxidizing gas flow and then resuming the normal retorting gas flow rate can be repeated as desired until the combustion zone reaches the side boundaries of the retort in a substantially flat horizontal wave as indicated by the dashed line 23 in FIG. 2. Remaining irregularities in this combustion zone are levelled out as normal retorting proceeds.

A variety of techniques can be used to determine if a heated zone, which includes a combustion zone, is substantially flat and uniformly transverse to the direction of its advancement through a fragmented mass. Exemplary of such techniques is the method described in U.S. patent application Ser. No. 796,700 filed on May 13, 1977, entitled "DETERMINING THE LOCUS OF A PROCESSING ZONE IN A RETORT THROUGH CHANNELS", filed by Gordon B. French, now U.S. Pat. No. 4,151,877 assigned to the assignee of this application, and incorporated herein by this reference. According to the '700 patent application, the locus of a heated zone in an in situ oil shale retort can be determined by withdrawing a sample of gas from the retort through a channel in unfragmented formation adjacent the retort, where the channel is in fluid communication with the retort. By analyzing the composition of the withdrawn gas for a constituent such as oxygen, the locus of the heated zone can be determined. To determine whether the heated zone is skewed and/or warped, gas samples can be withdrawn from the retort at a plurality of locations spaced apart from each other in a plane substantially normal to the direction of advancement of the heated zone.

Another technique for determining if a heated zone is non-planar and/or skewed is described in U.S. Pat. No. 4,082,145 entitled, "DETERMINING THE LOCUS OF A PROCESSING ZONE IN AN IN SITU OIL SHALE RETORT BY SOUND MONITORING", assigned to the assignee of this application, and incorporated herein by this reference. According to this patent, the locus of a heated zone advancing through a fragmented permeable mass of particles in an oil shale retort can be determined by monitoring for sound produced in the retort. Sound preferably is monitored at at least two locations, and more preferably, at at least three locations in a plane substantially normal to the direction of advancement of the heated zone through the fragmented mass to determine if the heated zone is flat and uniformly transverse to its direction of advancement. Monitoring can be effected by placing one or more sound transducers in a conduit extending into the fragmented mass and/or in a well extending through the formation adjacent the retort. Sound transducers are sensitive to sound intensity and/or to sounds characterizing a heated zone for distinguishing the sounds of a combustion zone and/or a retorting zone from those produced in other portions of the retort.

A further technique for determining the locus of a heated zone, such as a combustion zone, advancing through a retort is described in U.S. patent application Ser. No. 798,376 filed on May 9, 1977, by Robert S. Burton, entitled "USE OF CONTAINERS FOR DOPANTS TO DETERMINE THE LOCUS OF A PROCESSING ZONE IN A RETORT", now abandoned, assigned to the assignee of this application, and incorporated herein by this reference. According to this technique, container means for confining indicator means for providing an indicator for release at a predetermined temperature greater than ambient is placed at a selected location in a subterranean formation containing oil shale within the boundaries of an in situ oil shale retort to be formed in the formation. Then formation within the boundaries of the in situ oil shale retort to be formed is explosively fragmented to form an in situ retort containing a fragmented permeable mass of formation particles which contains the container. A heated zone is then advanced through the fragmented mass to form an effluent fluid such as off gas or shale oil and to release indicator means from the container. Effluent fluid from the retort is monitored for presence of indicator to determine the locus of the processing zone. By placing such container means spaced apart from each other in a plane substantially perpendicular to the direction of advancement of the heated zone, it can be determined whether the heated zone is skewed and/or warped.

By using one or more of these techniques, or other techniques, it can be determined whether the heated zone is substantially flat and horizontal and whether it extends all the way across the retort to the side boundaries of the retort. If it is determined that the heated zone is warped and/or skewed, the rate of introduction of gas into the retort can temporarily be reduced for a sufficient time to establish a substantially horizontal and flat heated zone. Thereafter, introduction of gas comprising an oxidizing gas into the combustion zone at a retorting rate for burning carbonaceous material in the oil shale can be resumed. Then, the locus of the heated zone can be determined to ascertain if the heated zone is substantially horizontal and flat using any of the above-described techniques or others. If the heated zone is not substantially horizontal and flat, the steps of reducing the rate of introduction of gas into the heated zone and thereafter resuming introduction of gas at a retorting rate can be repeated until a substantially flat and horizontal heated zone is established and maintained.

It will be noted that when the downward gas flow is reduced to a low level or shut off completely, heat is transferred laterally much nearer the top of the retort. This assures that a substantially flat horizontal combustion zone is created all the way across the retort in its uppermost regions. The loss of oil from the shale in the upper edges 24 therefore becomes quite nominal and the total yield from the retort can be significantly increased.

One can reduce gas flow simply by closing the conduit 12 at the top. This permits gas generated in the retort to flow downwardly through the retort and go out through tunnel 13. Such flow is very small, but prevents pressure build up due to accumulation of gas generated in the retort.

It should be noted that the time intervals involved in practice of this invention are relatively long. Thus, for example, ignition may take a few days of heating, the initial heating period at full retorting flow rate following ignition of the retort may be a week or more to heat a sufficient volume of oil shale above the self-ignition temperature of carbonaceous material contained therein. The temporary reduction of cessation of downward gas flow is preferably at least one week to permit adequate lateral transfer of heat. Shorter times may not sufficiently enhance the yield to be worthwhile. Two weeks or more of reduced flow may be involved in larger retorts or after the hot zone has moved a substantial distance down the retort. Preferably thermocouples or other temperature measuring devices are provided in the upper portions of the retort so that one is assured that temperatures do not drop below the self-ignition temperature of carbonaceous material in the oil shale.

The term "retorting" as used in this application means the heating of fragmented or rubblized oil shale in a retort by contacting it with a hot retorting fluid which is passed through the retort. The retorting fluid can be heated prior to its introduction into the retort or it can be passed through a combustion zone in the retort where it is heated and the heated retorting fluid then passes downwardly through the retort and liberates its heat to the fragmented oil shale that it contacts, heating it to a temperature sufficient to decompose the kerogen and produce shale oil and gas. The following is an illustrative example of a method of achieving a substantially flat, planar, horizontal combustion zone in a retort.

Ignition is initiated in an underground retort filled with fragmented oil shale of the kind described above and shown in the drawings by a method such as that described in the aforementioned U.S. Pat. Nos. 3,952,801 and 3,990,835. A combustible gas mixed with air is fed to the ignition point for a period of about three days so that a sufficient volume of oil shale is heated for combustion to be sustained in the presence of air and the flow of the combustible gas is then discontinued. After the termination of the flow of combustible gas, air is fed into the retort at the rate of about 0.62 standard cubic foot per minute (SCFM) per square foot of cross sectional area in the retort, for a period of about seven days in order that the combustion promoted thereby will heat a sufficient quantity of oil shale fragments to provide a source of radiation for the lateral extension of the combustion zone when the flow of air is reduced. Thermocouples (not shown) inserted into the fragmented oil shale near the side boundaries of the retort in the upper portion of the fragmented mass therein, indicate that the combustion zone is not extended to the side boundaries of the retort cavity during the ignition and the subsequent seven days of retorting. The composition of the off gas is noted after the discontinuance of the introduction of combustible gas into the retort chamber. Off gas is withdrawn from the bottom of the retort during the retorting operation. Shale oil liberated by the heat-caused decomposition of kerogen trickles down through the fragmented mass containing oil shale and is collected in a sump at the bottom of the retort from which it is withdrawn to storage. After the seven days of retorting the flow of air is reduced to less than about 0.1 SCFM per square foot of cross sectional area. The reduced flow of air is maintained until the combustion zone is extended radially to the walls of the retort as indicated by the thermocouples. The period of reduced flow in this instance is about seven days. After the combustion zone has spread laterally to the side boundaries of the retort cavity, the flow of air to the retort is increased to about 0.62 SCFM per square foot of cross sectional area. Such flow is maintained until the retorting zone reaches the bottom of the retort as indicated by thermocouples (not shown). The composition of the off gas after resumption of air flow is found to differ from that of the off gas after termination of the flow of combustible gas at the end of the abovementioned seven days of retorting, indicating that during such earlier periods there is apparently some oxidation or burning of shale oil in addition to retorting. A good yield of shale oil is obtained.

It will be noted that in case of some unexpected disturbance during operation of the retort, the downward flow of the combustion zone may become skewed and/or warped at some elevation well below the top. This might occur, for example, due to an abnormal particle size distribution. The presence of a heated zone which is skewed and/or warped can be determined by any of the techniques described above. If this is the case, repetition of the step of temporarily limiting gas flow to a minimum level of completely stopping introduction of gas into the heated zone can serve to again make the combustion zone substantially flat and horizontal. In one test in a retort 32 feet square, downward flow of inlet gas was eliminated for two weeks after over half of the oil shale had been retorted and a substantial increase in yield was obtained.

The process for making the heated zone in the retort more planar can also be used in a retort heated by an inert retorting gas although the reasons for doing so are less compelling than in a retort utilizing an oxidizing gas.

An unexpected advantage of the process of the present invention where a retort is first operated in a normal retorting operation, followed by a reduction in the rate of introduction of oxidizing gas into the retort, followed by resumption of normal retorting, is that enriched off gas of high heating value is produced during the second period of time. This off gas, which is referred to herein as "enriched off gas", has a heating value of at least about 75 BTU/SCF, and preferably has a heating value of at least about 150 BTU/SCF. In some situations, even when the retort contains a substantially flat combustion zone, it can be desirable to reduce the rate of introduction of gas into the retort for the purpose of producing such enriched off gas. As noted above, the process for making the heated zone in a retort more planar can also be used in a retort heated by an inert retorting gas. One reason for using this process for a retort heated by an inert retorting gas is to obtain enriched off gas of high heating value.

Although the basic step of reducing the rate of introduction of gas to a retort in the midst of a normal retorting operation is the same for both flattening a heated zone and for obtaining enriched off gas, the constraints upon the amount the rate of introduction is reduced can be different for these two purposes. However, in some situations, the constraints can yield the same results; for example, where the introduction of gas to the retort is substantially completely stopped. The constraints upon the amount the rate of introduction of gas into a retort is reduced for flattening a combustion zone are presented above. The constraints upon the amount the rate of introduction of gas to a retort is reduced to obtain enriched off gas is described below.

It should be noted that this concept of obtaining an enriched off gas is related to the concept of obtaining a post-retorting gas as described in U.S. patent application Ser. No. 763,155 filed on Jan. 27, 1977, now U.S. Pat. No. 4,105,072 of which this application is a continuation-in-part. In the '155 application, there is described a procedure for obtaining a post-retorting gas of high heating value after completion of a normal retorting operation. On the other hand, in the process described herein, off gas of enhanced heating value is obtained in the midst of a normal retorting operation, before completion of the retorting of an in situ oil shale retort.

Figure 3:
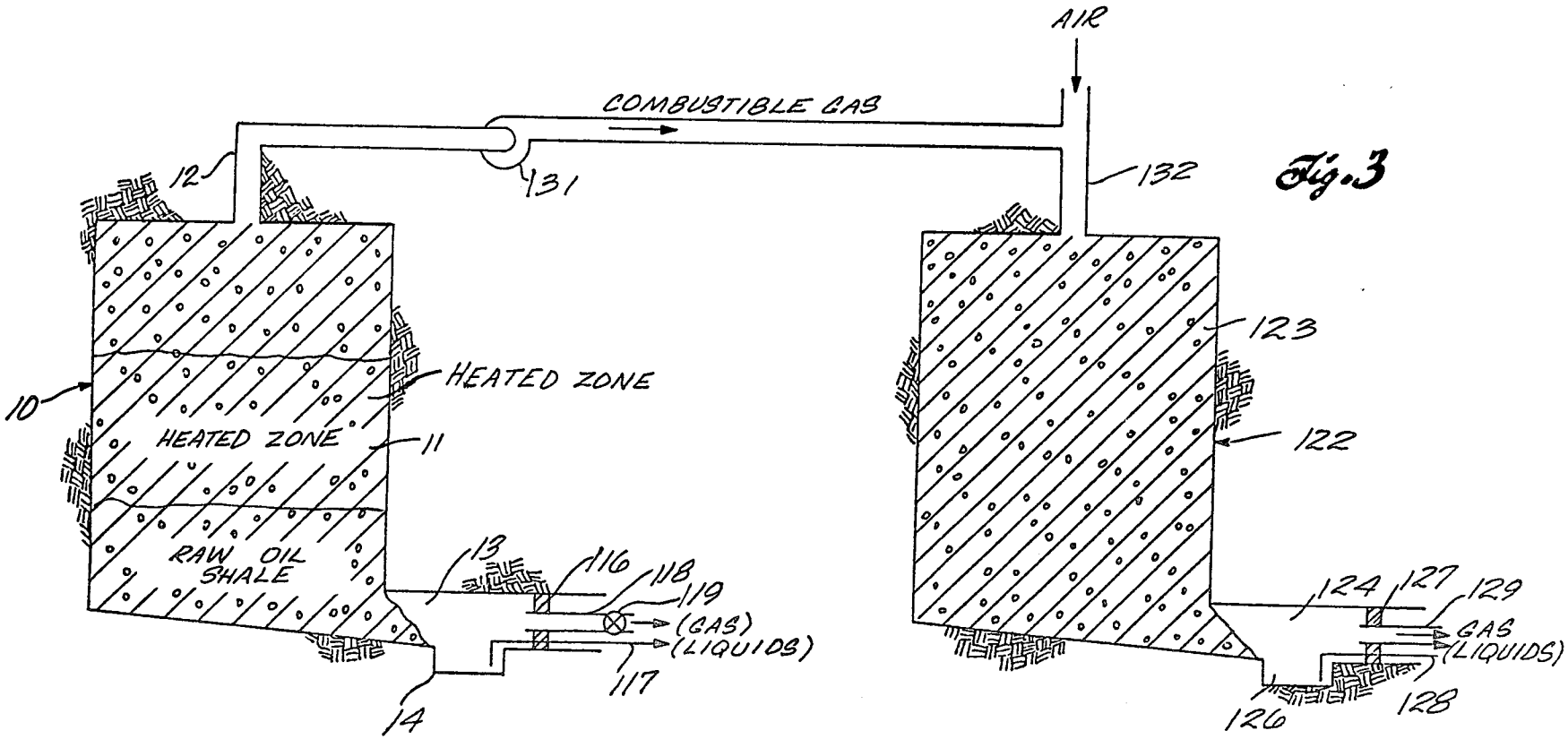
FIG. 3 is a schematic representation of two in situ oil shale retorts operating in accordance with principles of this invention.
Figure 4:
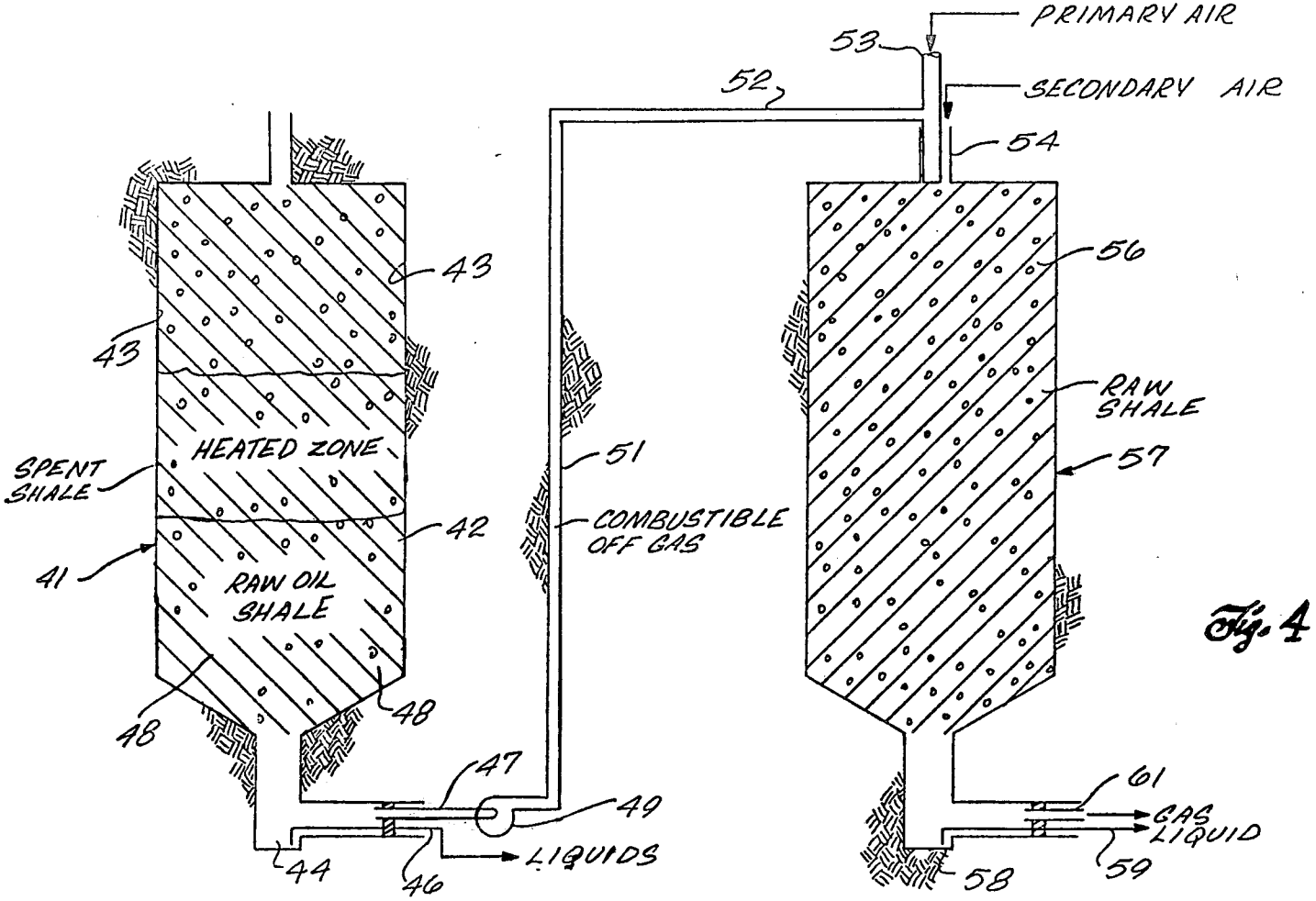
FIG. 4 is a schematic representation showing another embodiment wherein combustible off gas produced from an enrichment operation is used for establishing a heated zone in a new in situ retort.

This enrichment operation can best be understood with reference to FIGS. 3 and 4. FIG. 3 illustrates semischematically a pair of in situ oil shale retorts for practice of processes in accordance with this invention. The same reference numerals are applied for the structural elements of the retort shown on the left side of FIG. 3 as the reference numerals used for the retorts of FIGS. 1 and 2, since structurally the retort on the left side of FIG. 3 is the same as that illustrated in FIGS. 1 and 2. As illustrated in the embodiment of FIG. 3, there is a first in situ oil shale retort 10 which is in a subterranean formation containing oil shale. That in situ oil shale retort comprises a subterranean cavity in the formation containing a fragmented permeable mass 11 of particles of the formation containing oil shale. The sump 14 in the access drift 13 is between the fragmented permeable mass and a substantially gas tight bulkhead 116 in the access drift. A conduit 117 is provided through the bulkhead for withdrawing liquid products from the sump. A gas conduit 118 also extends through the bulkhead for withdrawing off gas from a lower portion of the fragmented mass in the retort. Means are also provided for closing the gas conduit 118, such as by way of a valve 119 illustrated schematically in FIG. 3.

During normal retorting operation, a processing gas such as an oxidizing gas is introduced through the conduit 12 at the upper portion of the fragmented permeable mass in the retort. A heated zone is established in the fragmented mass in the retort and advanced therethrough from the top toward the bottom. The heated zone is advanced through the fragmented mass by gas flow as processing gas is introduced at the top of the retort and an off gas is withdrawn at the bottom of the retort by way of the gas conduit 118. On the advancing side of the heated zone is a zone of raw oil shale.

The heated zone has a temperature at least as high as the retorting temperature for oil shale so that kerogen in oil shale in the retort is decomposed to produce liquid and gaseous products. Liquid products percolate to the sump 14 from which they are withdrawn and gaseous products are withdrawn with the off gas by way of the gas conduit 118.

As a heated zone comprising the combustion zone and retorting zone advances through the fragmented mass, its thickness or vertical height increases since the rate of heat generation is greater than the rate of cooling of spent shale on the trailing side of the combustion zone by relatively cool inlet processing gas. When kerogen decomposes in the retorting zone to produce liquid and gaseous products a solid carbonaceous residue remains in the shale. Such carbonaceous residue supports combustion in the combustion zone. An appreciable amount of such residual carbonaceous product can remain in the heated zone.

Thus, an appreciable resource is left in the heated zone as the combustion and retorting zones advance through the retort. This resource includes a high temperature source of heat in the heated zone, appreciable quantities of oil shale in pillars of unfragmented formation outside the boundaries of the fragmented permeable mass, and unburned residual carbonaceous product in retorted oil shale. Under some circumstances, unretorted oil shale can remain in the fragmented permeable mass above the combustion zone such as in the upper corners of the retort. Therefore, an enrichment operation is conducted for utilizing at least part of such resources and for generating an off gas of enhanced heating value.

FIG. 3 illustrates schematically an arrangement for such an enrichment operation. As illustrated in this embodiment, there is a second in situ oil shale retort 122 in the form of a cavity in unfragmented formation and containing a fragmented permeable mass 123 of particles containing oil shale. Such a retort is similar to the first retort 10 hereinabove described. An access drift 124 communicates with the lower portion of the fragmented mass in the in situ oil shale retort. A sump 126 is provided in the access drift. A substantially gas tight bulkhead 127 is provided in the access drift. A liquid withdrawal conduit 128 extends through the bulkhead from the sump 126. An off gas conduit 129 also extends through the bulkhead in the access drift.

In the arrangement illustrated in FIG. 3, the first mentioned in situ oil shale retort 10 is in the midst of normal retorting operation and the fragmented permeable mass 12 has been partially retorted; that is, kerogen in oil shale in the fragmented permeable mass has been heated and decomposed for producing gaseous and liquid products, thereby leaving solid residual carbonaceous product. A lower part of substantial height of fragmented mass in the retort has a heated zone at a temperature above the retorting temperature of oil shale. At least a portion of the heated zone contains solid residual carbonaceous product of kerogen decomposition. The second mentioned in situ oil shale retort 22 contains a fragmented permeable mass 23 containing raw or unprocessed oil shale; that is, oil shale which has not yet been subjected to processing for decomposition of kerogen.

During an enrichment operation as illustrated in FIG. 3, a gas blower 131 or the like has an inlet connected to the gas access 12 at the top of the first mentioned retort containing a heated zone. The outlet of the gas blower 131 is connected to a gas access conduit 132 to the top of the fragmented mass 123 in the second mentioned in situ oil shale retort containing a fragmented mass of unprocessed oil shale. Air or other oxygen containing gas is also introduced to the fragmented permeable mass of unprocessed oil shale in the second retort. Off gas withdrawn from the top of the retort containing a large heated zone is burned at the top of the retort containing a fragmented mass containing raw or unprocessed oil shale. Such burning of combustible off gas establishes a heated zone in the upper portion of the fragmented mass in the second retort. Sufficient heat can be introduced in this manner to raise the temperature of oil shale in the top of the fragmented mass to the ignition temperature of carbonaceous material in the oil shale, thereby providing ignition for a combustion zone to be established in the second retort. The second retort is so readied for normal retorting operations.

During such enrichment operation, the valve 119 is closed so that the lower portion of the in situ retort 10 containing the heated zone is substantially closed to introduction of gas. Heat from the heated zone in the fragmented permeable mass is transferred primarily by radiation and conduction in the fragmented mass and primarily by conduction in unfragmented pillars adjacent the fragmented mass. Such heat transfer from the heated zone raises the temperature of unfragmented formation adjacent the fragmented mass, and of unretorted particles containing oil shale within the fragmented mass, if any, to temperatures at which retorting of kerogen proceeds.

Thus, during enrichment operation of the first retort 10, additional decomposition of kerogen occurs, yielding gaseous and liquid products. Such gaseous products are withdrawn in off gas from the top of the fragmented mass. Liquid products produced during enrichment operation can percolate to the bottom and be withdrawn from the sump 14. At least a portion of such liquid products are exposed to sufficiently high temperatures that vaporization and/or thermal cracking occur. This results in additional gaseous products withdrawn in enriched off gas from the top of the fragmented mass. Under some conditions little liquid product accumulates in the sump at the bottom due to secondary thermal cracking.

Heat transfer by reason of gas flow in the fragmented mass is relatively small since the flow rate of gas is small by comparision with the flow rate of gas during normal retorting. The gas flow rate during an enrichment operation can be a few percent of the gas flow rate during normal retorting operation. Initially it can be about 15% of the normal retorting rate and gradually decrease.

It is preferred to maintain a pressure slightly below ambient pressure in adjacent underground workings for avoiding leakage of off gas from the retort into adjacent tunnels or drifts which may be occupied by personnel. A few inches of water negative pressure (pressure below ambient in adjacent workings) is sufficient to prevent such leakage. The rate of withdrawal of off gas from the retort during enrichment operation is at least sufficient to prevent pressure build-up inside the retort.

When gas from thermal decomposition is withdrawn from the retort and a slightly negative pressure maintained in the retort, there can be some leakage of air into the retort. Such flow is preferably minimized to avoid unwanted oxidation of fuel components of the off gas and dilution of the off gas, which would reduce its heating value.

Since there is minor gas flow due to continual withdrawal of relatively high heating value off gas from the retort, there is some minor heat transfer by way of the sensible heat of the off gas. Since during this second period of time, the gas flow is quite small by comparison with gas flow rate during normal retorting, convective heat transfer is small and sensible heat in the heated zone in transferred primarily by radiation and conduction.

Enriched off gas withdrawn from the top of the in situ oil shale retort during enrichment operation can be at a temperature substantially below the temperature of the heated zone since such gas passes through a zone of cooled shale between the heated zone and the gas access conduit 12 at the top of the fragmented mass.

Since there is no significant inlet gas flow to the retort, little heat is lost by way of convective heat transfer. Transfer of heat by radiation and conduction is relativelyslow, hence, the rate of cooling in the fragmented permeable mass in the retort is slow and the boundaries of the fragmented mass at the lower portion of the retort can be at a high temperature, e.g., greater than 1000° F., for a significantly extended period. This maintains continuous heat conduction from the heated zone in the fragmented mass into adjacent unfragmented formation to cause thermal decomposition of kerogen in oil shale in the pillars of unfragmented formation. The resulting liquid and gaseous products diffuse through the formation toward and into the retort, thereby recovering carbonaceous values from the unfragmented formation.

During an enrichment operation the enriched off gas withdrawn from the fragmented permeable mass can contain about 50 to 60% carbon dioxide (dry basis) with the balance made up primarily of gaseous hydrocarbons, hydrogen and carbon monoxide. Removal of carbon dioxide from the withdrawn off gas can raise the heating value to about 850 to 1000 BTU/SCF.

It will be noted that production rates of off gas and liquid products during normal retorting and during enrichment operation are dependent on a number of factors. During normal retorting operation some of these factors include oil shale grade (Fischer Assay), size of the retort, retorting rate, inlet gas composition and the like. During enrichment operation, production rates of off gas and liquid products depend on factors including oil shale grade, thickness or vertical height of the heated zone, size of the retort, and the like. Processes according to the present invention are particularly advantageous when employed in in situ oil shale retorts having substantial height and which have relatively rich oil shale near the bottom of the retort.

Enrichment operations can be conducted in two stages. During a first stage of enrichment operation, enriched off gas is withdrawn from the top of the retort with the bottom closed. This off gas has a heating value in excess of about 150 BTU/SCF and is suitable for burning at the top of a second in situ oil shale retort for establishing a heated zone at a sufficiently high temperature for ignition. Thus, during the first stage of enrichment operation the withdrawn off gas is employed for ignition of another in situ oil shale retort. Such a first stage of enrichment can persist for at least about two weeks which provides ample energy for ignition of a second retort.

Thereafter, during a second stage of enrichment operation the withdrawn off gas can be used for sustaining a secondary combustion zone in another in situ oil shale retort through which a primary combustion zone is advancing. Such a process including a secondary combustion zone is described in my copending U.S. patent application Ser. No. 844,035 filed on Oct. 20, 1977, now abandoned which is a continuation-in-part of U.S. patent application Ser. No. 728,911 filed Oct. 4, 1976, now abandoned, which is a continuation-in-part of application Ser. No. 648,358 filed Jan. 12, 1976, now abandoned, which is a continuation of application Ser. No. 465,097 filed Apr. 29, 1974, now abandoned, the disclosures of which are hereby incorporated by reference.

In the applications concerning a secondary combustion zone, there is described an in situ oil shale retort containing a fragmented permeable mass of particles containing oil shale. The retort has a primary combustion zone advancing therethrough. The inlet gas to the retort comprises a fuel and an oxygen supplying gas. These are introduced into a location in the fragmented mass on the trailing side of the primary combustion zone for forming a secondary combustion zone in the fragmented mass. As used herein, the term "secondary combustion zone" refers to the portion of the retort where the fuel in the retort inlet mixture is burned, and the term "primary combustion zone" refers to the portion of the retort with the greater part of the oxygen in the retort inlet mixture that reacts with residual carbonaceous material in retorted oil shale is consumed.

The retort inlet mixture containing fuel and oxygen supplying gas has a spontaneous ignition temperature lower than the temperature in the primary combustion zone and burns at a location in the fragmented mass on the trailing side of the primary combustion zone. Preferably sufficient heat is generated in the secondary combustion zone to maintain the temperature of the pillars adjacent the secondary combustion zone at a temperature above the retorting temperature of oil shale. If sufficient heat is generated in the secondary combustion zone, it can remain in a substantially fixed location in the in situ oil shale retort as the primary combustion zone advances.

Withdrawn enriched off gas should have a heating value of at least about 75 BTU/SCF to be employed for sustaining a secondary combustion zone in a fragmented permeable mass in another in situ retort. During such a second stage of enrichment operation heating value of the off gas can continue at a relatively high level or can decrease somewhat. The average off gas production rate decreases gradually.

Preferably the enrichment operation is ended and normal retorting is resumed before the heated zone in the fragmented mass is cooled below the spontaneous ignition temperature of kerogen in the fragmented mass, so that the combustion zone can be re-established in the fragmented mass by introducing an oxygen-containing gas into the retort. For such resumption, gas is introduced to the retort at a rate substantially equal to the rate at which gas is introduced to the retort prior to the enhancement operation.

Prior to resumption of normal retorting operation, purging gas can be introduced to the retort 10. The purpose of this is to avoid an explosion in the retort which could occur when an oxygen-containing gas is introduced into a hot retort containing gaseous hydrocarbons. The purging gas is substantially free of free oxygen and can be a gas such as nitrogen, carbon dioxide, low heating value off gas from an in situ oil shale retort, combustion products of a fuel, or combinations thereof.

Referring to FIG. 4, there is an in situ oil shale retort 41 containing a fragmented permeable bed 42 of broken pieces of formation containing oil shale. The fragmented mass 42 is bounded by walls 43 or pillars of unfragmented formation. The retort 41 contains spent shale from normal in situ retorting operation and includes a heated zone having substantial height. The spent shale can include a portion from which residual carbonaceous product has been burned as well as a portion not traversed by a combustion zone and hence containing solid residual carbonaceous product of kerogen decomposition. As hereinabove described, such normal retorting operation can include establishment of a combustion zone adjacent the top of the retort and advancement of the combustion zone downwardly through the fragmented mass. Heat from the combustion zone establishes and advances a retorting zone on the advancing side of the combustion zone. A retorting zone can also be advanced through a fragmented mass by introduction of hot inert gas during normal retorting operation. Kerogen is decomposed in the retorting zone, producing liquid products, including shale oil, which are collected at a sump 44 and withdrawn from the bottom of the retort by way of a liquid conduit 46. Off gas including hydrocarbons, hydrogen and carbon monoxide is withdrawn from the bottom of the retort by way of a gas conduit 47.

The length or vertical height of the heated zone in the fragmented mass at temperatures above the retorting temperature of oil shale increases continually during normal retorting operation. Therefore, the greatest height of the heated zone is obtained at the end of normal retorting operation. Preferably, the temperature of the heated zone is above about 1000° F. At such temperatures, radiant heat transfer from the heated zone to residual raw oil shale remaining in the fragmented mass and in unfragmented formation forming the boundaries of the retort is quite substantial.

Preferably the bottom of the retort is maintained at a slightly negative pressure, that is, at a pressure below the ambient pressure in adjacent underground workings. Such slightly negative pressure at the bottom of the retort is induced by continuously withdrawing off gas containing products of thermal decomposition including gaseous products from kerogen decomposition from the bottom of the retort by way of the conduit 47 and a gas blower 49 or the like.

Either of three gas inlet conditions can be maintained during such enrichment operation of the in situ oil shale retort 41.

As a first inlet condition, preferably the top of the retort is substantially closed so that introduction of gas at the top of the fragmented mass in the retort is prevented. When this is done downward flow of heat by way of gas flow or convection is minimized. Further, gaseous products in off gas withdrawn from the retort are not diluted by inlet gas. Such enrichment operation is similar to that hereinabove described with respect to FIG. 1.

As a second inlet condition, air flow into the top of the fragmented mass in the retort is maintained at a minimum sufficient to permit some combustion of carbonaceous material in the heated zone but insufficient to result in significant convective heat transfer. This can be accomplished either by reducing the rate of continuous air introduction or by providing intermittent air introduction by intermittently stopping air flow into the top of the retort. Such limited introduction of air during enrichment operation can help maintain an elevated temperature in the heated zone.

As a third inlet condition, gas introduced during enrichment operation can be a mixture containing water vapor and oxygen, such as a combination of steam and air. Normal retorting operation of an in situ oil shale retort can result in the presence of a substantial volume of fragmented permeable mass containing retorted oil shale in which residual carbonaceous product from kerogen decomposition remains. Such retorted oil shale is at elevated temperature and the carbonaceous material is in an active state.

Water vapor can react with such residual carbonaceous product by the water gas reaction $$H_2O+C=H_2+CO$$

Thus, some of the residual carbonaceous product can be used to produce combustible gases. The water gas reaction is endothermic and oxygen-containing gas such as air is also introduced for exothermic reaction with some of the residual carbonaceous product for counterbalancing the endothermic reaction and maintaining a sufficiently elevated temperature for the water gas reaction to proceed. When operating according to the second or third alternative inlet conditions during enrichment operation, the rate of introduction of gas to the top of the retort is less than about 10% of the rate of gas introduction during normal retorting operation.

It is preferable to completely stop introduction of gas to the top of the in situ oil shale retort during enrichment operation since additions tend to dilute gas produced by thermal decomposition in the retort. Such dilution can reduce the heating value of the withdrawn off gas without sufficient concomitant benefit. Another result of completely stopping is that sensible heat in the heated zone in the fragmented mass adjacent the bottom of the retort is transferred by radiation and conduction to raw oil shale 48 located at the lower portion of the retort.

Shale oil produced during enrichment operation has a relatively longer residence time in the heated zone than during normal retorting operation since a smaller quantity of liquid is produced and flow velocity is small. Therefore, shale oil produced by kerogen decomposition can undergo a secondary thermal cracking reaction resulting in production of combustible gas having a substantial heating value.

The heating value of the combustible off gas produced during enrichment operation can have considerable variation due to carbon dioxide in the off gas which results from thermal decomposition of inorganics in the shale. When off gas is withdrawn from the top of the fragmented mass in the in situ retort, heating values in excess of about 150 BTU/SCF can be obtained for a substantial period. Heating values of 200 to 250 BTU/SCF can be obtained under some circumstances. When off gas is withdrawn from the bottom of an in situ oil shale retort during enrichment operation, it can have a heating value of about 400 BTU/SCF. Lower heating values in the off gas withdrawn from the top of the retort can be attributed to additional dilution by carbon dioxide from thermal decomposition in the heated zone in the retort and additional thermal cracking of hydrocarbons to produce relatively lower density hydrogen. As mentioned above, heating value of enriched off gas from the in situ retort can depend at least partly on oil shale grade.

Since the rate of introduction of inlet gas to the fragmented permeable mass is low or stopped during enrichment operation, the rate of cooling of the heated zone is slow. Due to this slow cooling rate, the unfragmented walls 43 adjacent the lower portion of the in situ retort can be maintained at a high temperature for a long time to maintain continuous heat conduction from the fragmented permeable mass adjacent the pillars into the pillars. Shale oil and combustible gases resulting from thermal decomposition of oil shale in unfragmented formation diffuse toward and into the fragmented mass in the retort, thereby recovering carbonaceous values from the unfragmented formation in the pillars.

Thus, in addition to shale oil and combustible gases recovered from any residual unretorted oil shale in the fragmented mass in the retort, a significant amount of liquid and gaseous products is also recovered from the adjacent pillars during such enrichment operation.

The rate of production of combustible off gas during enrichment operation is sufficient for establishment of a heated zone in a new in situ oil shale retort. Thus, in this embodiment during enrichment operation combustible off gas withdrawn from the bottom of the first retort 41 by means of the blower 49 is conveyed upwardly through a raise or winze 51 to an upper level in the underground workings. A conduit 52 conveys such enriched off gas to a retort ignition burner 53. The burner 53 is positioned in a gas access means 54 leading to the top of a fragmented permeable mass 56 of raw oil shale in a second in situ oil shale retort 57. Primary air and secondary air are also introduced and the combustible off gas introduced into the burner 53 is ignited to establish a heated zone in the new retort 57. The flue gases from the burner 53 heat the top of the fragmented permeable mass and initiate the retorting process. The combustion of off gas is continued at least until the upper portion of the fragmented mass reaches a sufficiently high temperature to sustain combustion in a combustion zone. Temperatures of about 1200° to 1400° F. are desirable to assure self-sustaining combustion.

At this stage burning of combustible off gas by means of the burner 53 is discontinued and normal retorting operation is conducted by introducing air and off gas from the conduit 52 into the top of the second retort 57. Introduction of off gas to the top of the second fragmented permeable mass can be discontinued when the fragmented mass will sustain combustion or, if desired, can be continued to sustain a secondary combustion zone as hereinabove described. Off gas can also be used to dilute inlet air to reduce oxygen concentration without requiring appreciable heating value.

Retorting of the second in situ retort 57 can be coducted by normal retorting operation with liquid products withdrawn from a sump 58 by way of a liquid conduit 59. Off gas is withdrawn from the bottom of the second retort by way of a gas conduit 61.

It is preferred to withdraw relatively high heating value off gas from the top of an in situ oil shale retort during enrichment operations and convey such gas to the top of a new in situ oil shale retort since this minimizes the length and complexity of piping that is needed. The new in situ oil shale retort is ignited at the top and by withdrawing relatively rich off gas from the top of an active oil shale retort, the gas can be conducted to the new retort at the same level in the underground workings. This avoids any need for a raise or winze through which off gas must flow between different levels in the underground workings.

When off gas is withdrawn from the bottom of the retort during enrichment operation, there can also be appreciable production of shale oil and water from the retort. Liquid products percolate to the sump and are recovered. The production rate of liquid products during enrichment operation is considerably lower than during normal in situ oil shale retorting.

When enriched off gas is withdrawn from the top of the retort during an enrichment operation, no more than a small amount of shale oil and water percolates to the sump at the bottom of the retort. Liquid decomposition products of kerogen pass through high temperature regions of the in situ oil shale retort and are subjected to thermal cracking conditions. Most or all of the carbonaceous materials are cracked to produce gaseous products which enrich the relatively high heating value off gas.

When enriched off gas is withdrawn from the bottom of the retort during enrichment operation, oxygen-containing gas can be introduced at the top of the fragmented permeable mass for limited combustion. The heated zone can include a substantial amount of carbonaceous residue, combustion of which depletes the oxygen concentration of the gas and avoids burning combustible components of off gas produced near the bottom of the retort. It is desirable to prevent introduction of oxygen-containing gas into the bottom of an in situ oil shale retort when off gas is withdrawn from the top. The greater proportion of liquid and gaseous products are produced near the bottom. These can be oxidized before such gas introduced at the bottom passes through a sufficient thickness of heated zone containing carbonaceous residue to adequately deplete oxygen in the introduced gas.

While particular embodiments of processes provided in practice of this invention have been described herein for purposes of illustration, it will be understood that various changes and modifications within the spirit of the invention can be made. Thus, for example, in the embodiments illustrated in the drawings, relatively rich off gas from enrichment operation of a retort is introduced at the top of a second retort for ignition or for sustaining a secondary combustion zone. It will be apparent that relatively high heating value off gas from enrichment operation can be used for other purposes such as production of power, making steam for injecting in a retort, product heating or general heating of facilities and equipment.

In addition, although the figures show a retort where the combustion and retorting zones are advanced downwardly through the retort, this invention is also useful for retorts where the combustion and retorting zones are advancing upwardly or transverse to the vertical. Furthermore, this invention is also useful for retorts where the combustion zone is established other than at the top of the fragmented mass in the retort. It is therefore to be understood that the invention is not limited except by the scope of the appended claims.

What is claimed is:

1. A process for establishing a relatively planar combustion zone in an oil shale retort containing particles containing oil shale comprising carbonaceous material, the process comprising the steps of:

igniting a portion of the particles in the retort for establishing a combustion zone in the oil shale retort;

introducing, for a first period of time, an oxidizing gas into the combustion zone at a rate sufficient for burning of carbonaceous material in the oil shale in the combustion zone through the retort and establishing of a retorting zone in the oil shale retort on the advancing side of the combustion zone;

for a second period of time, removing gas from the retort and reducing the introduction of oxidizing gas into the combustion zone to a rate such that substantially no heat is transferred by gas flow from the combustion zone to the retorting zone, such rate being no more than about of the same order of magnitude as the rate of flow of gas generated in the retort due to thermal decomposition, for permitting lateral heat transfer without significant advancement of the combustion zone; and thereafter resuming introduction of oxidizing gas into the combustion zone at a rate sufficient to effect the transfer of heat from the combustion zone at a rate sufficient to effect advancement of the combustion zone through the retort.

2. A process as defined in claim 1 wherein the step of reducing the introduction of gas comprises substantially completely stopping the introduction of gas into the combustion zone.

3. A process as defined in claim 1 wherein the step of reducing the introduction of gas is continued for at least one week.

4. A process as defined in claim 1 wherein the steps of resuming introduction of gas and reducing the introduction of gas are alternately repeated until oil shale adjacent walls of the retort is heated above the self-ignition temperature of carbonaceous material in the oil shale.

5. A process as defined in claim 1 wherein the step of reducing the introduction of gas is continued until oil shale adjacent walls of the retort is heated above the self-ignition temperature of carbonaceous material in the oil shale.

6. A process as defined in claim 1 wherein the step of reducing the rate of introduction of gas comprises closing an inlet to the retort to minimize heat transfer by gas flow and withdrawing a sufficient volume of gas from an outlet of the retort to prevent pressure build up inside the retort.

7. The method of claim 1 wherein the step of removing gas from the retort for a second period of time comprises removing gas having a heating value of at least about 150 BTU/SCF.

8. The method of claim 1 wherein the step of reducing the introduction of oxidizing gas into the combustion zone comprises reducing the introduction of oxidizing gas to a rate less than about 10% of the rate of introduction of oxidizing gas during the first period of time.

9. A process as defined in claim 1 wherein during the second period of time gas containing water vapor is introduced into the in situ retort for water gas reaction with residual carbonaceous product from retorting oil shale in the retorting zone, and wherein the gas removed includes reaction products of the water gas reaction.

10. A process as defined in claim 9 wherein the introduced gas containing water vapor also contains oxygen for exothermic reaction for at least partially counterbalancing endothermic water gas reaction.

11. In a process as recited in claim 1 the further improvement wherein pressure in the in situ retort during the second period of time is maintained below ambient pressure in adjacent underground workings.

12. A process for flattening a combustion zone in a vertical oil shale retort containing a fragmented permeable mass of particles containing oil shale comprising carbonaceous material, the process comprising the steps of:

establishing a combustion zone in the fragmented permeable mass in the oil shale retort;

introducing an oxidizing gas downwardly into the combustion zone for burning carbonaceous material in the oil shale in the combustion zone, advancing the combustion zone downwardly through the fragmented mass, heating a substantial volume of the fragmented permeable mass in a heated zone to a temperature above the self-ignition temperature of carbonaceous material in the oil shale, and propagating heat downwardly by gas flow from the combustion zone for retorting oil shale in a retorting zone on the advancing side of the combustion zone;

temporarily substantially stopping downward propagation of heat by gas flow in the retort for a sufficient time to raise the temperature of lateral portions of the retort adjacent the heated zone above self-ignition temperature of carbonaceous material in the oil shale; and repeating the step of introducing oxidizing gas downwardly into the combustion zone for burning carbonaceous material in the oil shale and advancing the combustion zone downwardly through the fragmented mass.

13. A process as defined in claim 12 wherein the step of temporarily substantially stopping downward propagation of heat comprises the step of temporarily reducing the downward introduction of gas into the combustion zone to no more than about the same order of magnitude as the amount of gas generated in the retort due to thermal decomposition.

14. A process as defined in claim 13 wherein the step of temporarily reducing the downward introduction of gas is continued for a sufficient time to raise the temperature of oil shale adjacent walls of the retort adjacent the combustion zone to the self-ignition temperature of carbonaceous material in oil shale.

15. A process as defined in claim 13 wherein the steps of temporarily reducing the downward introduction of gas and again introducing an oxidizing gas downwardly into the combustion zone are alternately repeated until oil shale adjacent walls of the retort is heated to a temperature above the self-ignition temperature of carbonaceous material in oil shale.

16. A process as defined in claim 13 wherein the step of temporarily reducing downward introduction of gas comprises substantially completely stopping the introduction of gas into the combustion zone.

17. A process as defined in claim 13 wherein the step of temporarily reducing comprises closing the top of the retort to minimize heat transfer by gas flow in the retort and withdrawing sufficient gas from the bottom of the retort to prevent pressure build up due to gas generated inside the retort.

18. A process as defined in claim 17 wherein the steps of temporarily reducing the downward introduction of gas and again introducing oxidizing gas downwardly are alternately repeated until oil shale adjacent walls of the retort is heated to a temperature above the self-ignition temperature of carbonaceous material in oil shale.

19. A process as defined in claim 17 wherein the step of withdrawing gas from the bottom of the retort comprises withdrawing gas having a heating value of at least 150 BTU/SCF.

20. A process as defined in claim 12 wherein the combustion zone is first advanced through the fragmented mass until a sufficient volume of shale has been heated above the self-ignition temperature of carbonaceous material in oil shale that oil shale adjacent walls of the retort can be heated above the self-ignition temperature of carbonaceous material in oil shale without cooling the shale in center portions of the retort below the self-ignition temperature of carbonaceous material in oil shale during the temporary stopping of introduction of gas into the combustion zone.

21. A process for establishing a relatively horizontal combustion zone in a vertical in situ oil shale retort containing oil shale particles comprising the steps of:

igniting a top portion of the shale particles in the in situ oil shale retort for establishing a heated zone including a combustion zone in the in situ oil shale retort;

introducing a gas comprising an oxidizing gas downwardly into the heated zone at a retorting rate for burning carbonaceous material in the oil shale in the combustion zone and advancing the heated zone downwardly through the retort;

while withdrawing gas from the retort, temporarily reducing downward introduction of gas into the heated zone to a rate wherein the rate of heat transfer by gas flow is no more than about the rate of conductive and radiative heat transfer; and thereafter resuming downward introduction of gas into the heated zone at a retorting rate.

22. A process as defined in claim 21 wherein the step of temporarily reducing comprises substantially completely stopping introduction of gas into the combustion zone.

23. A process as defined in claim 22 wherein the steps of temporarily substantially completely stopping the downward introduction of gas and again introducing oxidizing gas downwardly are alternately repeated until oil shale adjacent walls of the retort is heated to a temperature above the self-ignition temperature of carbonaceous material in oil shale.

24. A process as defined in claim 21 wherein the step of temporarily reducing downward introduction of gas is continued for at least one week.

25. A process as defined in claim 21 wherein the step of withdrawing gas from the retort comprises withdrawing from the retort gas having a heating value of at least about 150 BTU/SCF.

26. A process for decreasing the curvature of a retorting zone in an oil shale retort having particles of oil shale comprising carbonaceous material therein comprising the steps of:

moving a retorting gas through the retort at a retorting rate for heating the shale, decomposing carbonaceous material in the oil shale in a retorting zone and advancing the retorting zone through the retort in the direction of movement of the retorting gas;

temporarily reducing retorting gas flow through the retort to a rate less than the retorting rate and no more than about the same order of magnitude as the rate of flow of gas generated in the retort due to thermal decomposition while withdrawing from the retort such gas generated in the retort due to thermal decomposition; and thereafter resuming retorting gas flow through the retort at a retorting rate.

27. A process as defined in claim 26 wherein the step of temporarily reducing comprises substantially completely stopping retorting gas flow through the retort.

28. A process as defined in claim 26 wherein the step of temporarily reducing downward gas flow is continued for at least one week.

29. A process as defined in claim 26 wherein the steps of resuming gas flow and temporarily reducing gas flow are alternately repeated until oil shale adjacent walls of the retort is heated above its retorting temperature.

30. A process as defined in claim 26 wherein the step of temporarily reducing gas flow is continued until oil shale adjacent walls of the retort is heated above its retorting temperature.

31. A process as defined in claim 26 wherein gas flow is downwardly through the retort and wherein the step of temporarily reducing comprises closing the top of the retort to minimize downward heat transfer by gas flow and withdrawing a sufficient volume of gas from the bottom of the retort to prevent pressure build up inside the retort.

32. A process as defined in claim 31 wherein the steps of resuming gas flow and temporarily reducing downward gas glow are alternately repeated until oil shale adjacent walls of the retort is heated above its retorting temperature.

33. A process as defined in claim 31 wherein the step of temporarily reducing downward gas flow is continued until oil shale adjacent walls of the retort is heated above its retorting temperature.

34. A process as defined in claim 31 wherein the step of temporarily reducing downward gas flow is continued for at least one week.

35. A process as defined in claim 31 wherein the step of withdrawing gas from the bottom of the retort comprises withdrawing a sufficient volume of gas from the bottom of the retort so that the pressure in the retort is maintained below ambient pressure in adjacent underground workings.

36. A process as defined in claim 26 wherein the step of withdrawing from the retort gas generated in the retort comprises withdrawing a sufficient volume of gas from the retort so that the pressure in the retort is maintained below ambient pressure in adjacent underground workings.

37. A process as defined in claim 26 wherein the step of withdrawing from the retort gas generated in the retort comprises withdrawing gas having a heating value of at least about 150 BTU/SCF.

38. A process for flattening a combustion zone in a fragmented mass of particles containing oil shale in an oil shale retort comprising the steps of:

igniting a portion of the mass of particles for establishing a heated zone including a combustion zone in the oil shale retort;

introducing, for a first period of time, a gas including an oxidizing gas into the retort and heated zone at a rate sufficient to effect advancement of the heated zone through the fragmented mass and flow of heated gas through the retort on the advancing side of the combustion zone for retorting oil shale in a retorting zone on the advancing side of the combustion zone;

for a second period of time, while withdrawing gas from the retort, reducing the introduction of gas into the retort to a rate such that the flow of heated gas through the retort for retorting oil shale in such retorting zone is substantially reduced for sufficient time to appreciably flatten the heated zone; and thereafter resuming introduction of a gas including an oxidizing gas into the retort and heated zone at a rate sufficient to effect advancement of the heated zone through the fragmented mass.

39. A process as defined in claim 38 wherein the step of reducing the introduction of gas comprises substantially completely stopping the introduction of gas into the heated zone.

40. A process as defined in claim 38 wherein the step of withdrawing gas from the retort for a second period of time comprises withdrawing gas having a heating value of at least about 150 BTU/SCF.

41. A process for establishing an approximately horizontal combustion zone in a vertical in situ oil shale retort containing oil shale particles comprising carbonaceous material, the process comprising the steps of:

igniting a top portion of the oil shale particles in the in situ oil shale retort for establishing a heated zone including a combustion zone in the in situ oil shale retort;

introducing a gas comprising an oxidizing gas downwardly into the heated zone at a retorting rate for burning carbonaceous material in the oil shale in the combustion zone and advancing the heated zone downwardly through the retort;

temporarily reducing downward introduction of gas into the heated zone to a rate wherein the rate of downward heat transfer is decreased with respect to lateral heat transfer for a sufficient time to establish an approximately horizontal heated zone; and thereafter resuming introduction of gas comprising an oxidizing gas into the heated zone at a retorting rate.

42. A process as defined in claim 41 wherein the step of temporarily reducing downward introduction of gas comprises substantially completely stopping the introduction of gas into the heated zone.

43. A process for decreasing the curvature of a retorting zone in an oil shale retort having particles of oil shale comprising carbonaceous material therein comprising the steps of:

moving a retorting gas through the retort at a retorting rate for heating the oil shale, decomposing carbonaceous material in the oil shale in a retorting zone and advancing the retorting zone through the retort in the direction of movement of the retorting gas;

temporarily reducing retorting gas flow through the retort to a rate wherein the rate of heat transfer in the direction of retorting gas flow is decreased with respect to lateral heat transfer for a sufficient time to appreciably decrease the curvature of the retorting zone; and thereafter resuming retorting gas flow through the retort at a retorting rate.

44. A process as defined in claim 43 wherein the step of temporarily reducing retorting gas flow comprises substantially completely stopping retorting gas flow through the retort.

45. The process for maintaining a substantially flat combustion zone in a fragmented mass of particles containing oil shale in an oil shale retort comprising the steps of:

igniting a portion of the mass of particles for establishing a heated zone including a combustion zone in the oil shale retort;

introducing, for a first period of time, a gas including an oxidizing gas into the retort and heated zone at a rate sufficient to effect advancement of the heated zone through the fragmented mass and flow of heated gas through the retort on the advancing side of the combustion zone for retorting oil shale in a retorting zone on the advancing side of the combustion zone;

monitoring the locus of the combustion zone to determine if the combustion zone is substantially flat, if the combustion zone is not substantially flat, for a second period of time, reducing the introduction of gas into the retort to a rate such that the flow of heated gas through the retort for retorting oil shale in such retorting zone is substantially reduced for a sufficient time to appreciably flatten the heated zone; and thereafter resuming introduction of gas including an oxidizing gas into the retort and heated zone at a rate sufficient to effect advancement of the heated zone through the fragmented mass.

46. A process as defined in claim 45 wherein the step of reducing the introduction of gas comprises substantially completely stopping the introduction of gas into the heated zone.

47. A process for maintaining a substantially horizontal combustion zone in a vertical in situ oil shale retort containing oil shale particles comprising carbonaceous material, the process comprising the steps of:

igniting a top portion of the oil shale particles in the in situ oil shale retort for establishing a heated zone including a combustion zone in the in situ oil shale retort;

introducing a gas comprising an oxidizing gas downwardly into the heated zone at a retorting rate for burning carbonaceous material in the oil shale in the combustion zone and advancing the heated zone downwardly through the retort;

monitoring the locus of the combustion zone to determine if the combustion zone is substantially horizontal; if the combustion zone is not substantially horizontal, temporarily reducing downward introduction of gas into the heated zone to a rate wherein the rate of downward heat transfer is decreased with respect to lateral heat transfer for a sufficient time to establish a substantially horizontal heated zone; and thereafter resuming introduction of gas comprising an oxidizing gas into the heated zone at a retorting rate.

48. A process as defined in claim 47 wherein the step of temporarily reducing downward introduction of gas comprises substantially completely stopping the introduction of gas into the heated zone.

49. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and thereafter for a second period of an enrichment operation, reducing the rate of introduction of gas to the fragmented mass, and withdrawing from the retort an enriched off gas comprising gaseous products from retorting oil shale, the rate of introduction of gas to the fragmented mass being such that withdrawn enriched off gas has a heating value of at least about 150 BTU/SCF; and thereafter increasing the rate of introduction of gas to the fragmented mass.

50. A process as defined in claim 49 in which the step of reducing introduction of gas comprises substantially completely stopping introduction of gas to the fragmented mass.

51. A process as defined in claim 49 wherein during the enrichment operation gas containing water vapor is introduced into the in situ retort for water gas reaction with residual carbonaceous product from retorting oil shale in the heated zone, and wherein the off gas withdrawn includes reaction products of the water gas reaction.

52. A process as defined in claim 51 wherein the introduced gas containing water vapor also contains oxygen for exothermic reaction for at least partly counterbalancing endothermic water gas reaction.

53. In a process as defined in claim 49 wherein during the period of normal retorting operation the heated zone is advanced downwardly through the fragmented mass, the further improvement during the period of enrichment operation comprising the steps of:

conveying at least a portion of the enriched off gas from the top of the in situ retort to the top of another in situ oil shale retort containing a fragmented permeable mass of particles containing unretorted oil shale; and burning the conveyed enriched off gas at the top of the other retort containing a fragmented mass containing unretorted oil shale for establishing a heated zone therein.

54. A process as defined in claim 49 wherein the heated zone is advancing downwardly through the fragmented mass and during the enrichment operation, the rate of introduction of gas to the fragmented mass is reduced to a rate wherein the rate of downward heat transfer is decreased with respect to lateral heat transfer for a sufficient time to establish an approximately horizontal heated zone.

55. A process as defined in claim 49 in which the step of increasing the rate of introduction of gas comprises increasing the rate of introduction of gas to the fragmented mass to a rate substantially equal to the rate of introduction of processing gas to the fragmented mass during the normal retorting operation.

56. A process as defined in claim 49 wherein the heated zone comprises a combustion zone and the step of increasing the rate of introduction of gas to the fragmented mass comprises introducing an oxygen containing gas to the fragmented mass on a trailing side of the combustion zone, the process including the step of introducing a purging gas substantially free of free oxygen to the fragmented mass before introducing the oxygen containing gas to the fragmented mass.

57. In a process as defined in claim 49 the further improvement wherein the pressure in the in situ retort during the period of enrichment operation is maintained below ambient pressure in adjacent underground workings.

58. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and thereafter for a second period of enrichment operation reducing the introduction of gas to the fragmented mass to a rate less than about 10% of the rate of introduction of gas during normal retorting operation, and withdrawing from the retort an enriched off gas comprising gaseous products from retorting oil shale; and thereafter increasing the rate of introduction of gas to the fragmented mass.

59. A process as defined in claim 58 in which the step of increasing the rate of introduction of gas comprises increasing the rate of introduction of gas to the fragmented mass to a rate substantially equal to the rate of introduction of processing gas to the fragmented mass during the normal retorting operation.

60. A process as defined in claim 58 wherein the heated zone comprises a combustion zone and the step of increasing the rate of introduction of gas to the fragmented mass comprises introducing an oxygen containing gas to the fragmented mass on a trailing side of the combustion zone, the process including the step of introducing a purging gas substantially free of free oxygen to the fragmented mass efore introducing the oxygen containing gas to the fragmented mass.

61. A process as defined in claim 58 in which the step of reducing introduction of gas comprises substantially completely stopping introduction of gas to the fragmented mass.

62. A process as defined in claim 58 wherein introduction of gas is reduced to a rate such that enriched off gas withdrawn from the retort during the period of enrichment operation has a heating value of at least about 75 BTU/SCF.

63. A process as defined in claim 58 wherein introduction of gas is reduced to a rate such that enriched off gas withdrawn from the retort during the period of enrichment operation has a heating value of at least about 150 BTU/SCF.

64. A process as defined in claim 58 wherein during the enrichment operation gas containing water vapor is introduced into the in situ retort for water gas reaction with residual carbonaceous product from retorting oil shale in the heated zone, and wherein the enriched off gas withdrawn includes reaction products of the water gas reaction.

65. A process as defined in claim 64 wherein the introduced gas containing water vapor also contains oxygen for exothermic reaction for a least partly counterbalancing endothermic water gas reaction.

66. A process as defined in claim 58 wherein at least a portion of the subterranean formation adjacent the heated zone in the fragmented mass remains at a temperature of at least about 1000° F. during enrichment operation.

67. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and for a second period of an enrichment operation introducing gas to the fragmented mass at a rate less than about 10% of the rate of introduction of gas during normal retorting operation, and withdrawing from the retort an enriched off gas comprising gaseous products from retorting oil shale; and thereafter increasing the rate of introduction of gas to the fragmented mass.

68. A process as defined in claim 67 wherein gas is introduced at a rate during the period of enrichment operation such that enriched off gas withdrawn from the retort has a heating value of at least about 75 BTU/SCF.

69. A process as defined in claim 67 wherein gas is introduced at a rate during the period of enrichment operation such that enriched off gas withdrawn from the retort has a heating value of at least about 150 BTU/SCF.

70. A process as defined in claim 67 wherein during the enrichment operation gas containing water vapor is introduced into the in situ retort for water gas reaction with residual carbonaceous product from retorting oil shale in the heated zone, and wherein the enrichment off gas withdrawn includes reaction products of the water gas reaction.

71. A process as defined in claim 70 wherein the introduced gas containing water vapor also contains oxygen for exothermic reaction for at least partly counterbalancing endothermic water gas reaction.

72. In a process as defined in claim 67 the further improvement wherein pressure in the in situ retort during the period of enrichment operation is maintained below ambient pressure in adjacent underground workings.

73. A process as defined in claim 67 wherein at least a portion of the subterranean formation adjacent the heated zone in the fragmented mass remains at a temperature of at least about 1000° F. during enrichment operation.

74. A process for recovering liquid and gaseous products from oil shale in an in situ oil shale retort in a subterranean formation containing oil shale, the retort containing a fragmented permeable mass of formation particles containing oil shale, comprising the steps of:

establishing a heated zone in the fragmented mass, the heated zone having a temperature higher than the retorting temperature of oil shale;

for a first period of normal retorting operation introducing a processing gas to the fragmented mass on a trailing side of the heated zone at a sufficient rate for advancing the heated zone through the fragmented mass for retorting oil shale to produce liquid and gaseous products, and withdrawing liquid products and off gas containing gaseous products from the retort on an advancing side of the heated zone; and thereafter for a second period of enrichment operation introducing gas to the fragmented mass and withdrawing from the retort an enriched off gas comprising gaseous products from retorting oil shale, the rate of introduction of gas to the fragmented mass being such that withdrawn enriched off gas has a heating value of not less than about 150 BTU/SCF; and thereafter resuming introduction of processing gas to the fragmented mass at a rate substantially equal to the rate of introduction of processing gas for the first period.

75. A process as defined in claim 74 wherein during the enrichment operation gas containing water vapor is introduced into the in situ retort for water gas reaction with residual carbonaceous product from retorting oil shale in the heated zone, and wherein the enriched off gas withdrawn includes reaction products of the water gas reaction.

76. A process defined in claim 74 wherein the introduced gas containing water vapor also contains oxygen for exothermic reaction for at least partly counterbalancing endothermic water gas reaction.

77. A process for recovering liquid and gaseous products from oil shale in a first in situ oil shale retort in a subterranean formation containing oil shale, the first retort containing a fragmented permeable mass of formation particles containing oil shale, comprising the steps of:

establishing a heated zone in a portion of the fragmented mass in the first retort, the heated zone having a temperature higher than the retorting temperature of oil shale;

for a first period of normal retorting operation introducing a processing gas to a portion of the fragmented mass on a trailing side of the heated zone in the first retort at a sufficient rate for advancing the heated zone through the fragmented mass in the first retort for retorting oil shale to produce liquid and gaseous products, and withdrawing liquid products and off gas containing gaseous products from the first retort; and thereafter for a second period of enrichment operation substantially completely stopping introduction of gas to the first retort; continuing to withdraw an enriched off gas from the top of the first retort, said enriched off gas comprising gaseous products from retorting oil shale;

conveying at least a portion of the enriched off gas from the first in situ retort to a second in situ oil shale retort containing a fragmented permeable mass of particles containing unretorted oil shale; and burning the conveyed enriched off gas for establishing a heated zone therein; and for a third period after the second period introducing a processing gas to the fragmented mass on a trailing side of the heated zone in the first retort at a sufficient rate for advancing the heated zone through the fragmented mass in the first retort.

78. A process as defined in claim 77 wherein pressure in the first in situ retort during enrichment operation is maintained below ambient pressure in adjacent underground workings.

79. A process as defined in claim 77 wherein enriched off gas withdrawn from the first retort and conveyed to the second retort has a heating value of at least about 150 BTU/SCF.

80. A process as defined in claim 77 further comprising the steps of:

withdrawing enriched off gas having a heating value of at least about 75 BTU/SCF from the first retort after a heated zone is established in the second retort;

introducing at least a portion of the enriched off gas having a heating value of at least about 75 BTU/SCF into the second retort; and introducing an oxygen containing gas into the second retort for combustion of introduced enriched off gas.

81. A process as defined in claim 77 wherein the heated zone comprises a combustion zone and the processing gas introduced to the first retort during the third period comprises oxygen, the process including the step of introducing a purging gas substantially free of free oxygen to the top of the first retort before the third period.

82. A process as defined in claim 77 wherein processing gas is introduced to the first retort for the third period at a rate substantially equal to the rate at which processing gas is introduced to the first retort for the first period.

83. A process for recovering liquid and gaseous products from oil shale in a first in situ oil shale retort in a subterranean formation containing oil shale, the first retort containing a fragmented permeable mass of formation particles containing oil shale, comprising the steps of:

establishing a heated zone in an upper portion of the fragmented mass in the first retort, the heated zone having a temperature higher than the retorting temperature of oil shale;

for a first period of normal retorting operation introducing a processing gas to an upper portion of the fragmented mass on a trailing side of the heated zone in the first retort, at a sufficient rate for advancing the heated zone downwardly through the fragmented mass for retorting oil shale to produce liquid and gaseous products, and withdrawing liquid products and off gas containing gaseous products from the bottom of the first retort; and for a second period of enrichment operation substantially completely stopping introduction of gas to the first retort and substantially closing the bottom of the first retort; withdrawing an enriched gas from the top of the first retort, said enriched off gas comprising gaseous products from retorting oil shale and having a heating value of at least about 75 BTU/SCF;

introducing at least a portion of the enriched off gas from the top of the first retort into the top of a second in situ oil shale retort containing an at least partly unretorted fragmented permeable mass of particles containing oil shale;

introducing an oxygen containing gas into the top of the second retort for combustion of introduced enriched off gas; and for a third period after the second period resuming introduction of processing gas to the first retort.

84. A process as defined in claim 83 wherein off gas withdrawn from the first retort and conveyed to the second retort during the period of enrichment operation has a heating value of at least about 150 BTU/SCF.

85. A process as defined in claim 83 wherein at least a portion of the subterranean formation adjacent the heated zone in the fragmented mass remains at a temperature of at least about 1000° F. during enrichment operation.

86. In a process for recovering liquid and gaseous products from oil shale in an in situ oil shale retort in a subterranean formation containing oil shale wherein during normal retorting operation, a retorting zone is advanced downwardly through a fragmented permeable mass of formation particles containing oil shale in the retort, the improvement in an enrichment operation after the normal retorting operation wherein;

the bottom of the retort is substantially closed during enrichment operation;

enriched off gas including gaseous products from retorting oil shale is withdrawn from the top of the in situ retort; and subsequent to the enrichment operation, the normal retorting operation is resumed.

87. A process as defined in claim 86 wherein during the resumed normal retorting operation an oxygen containing gas is introduced to the top of the retort, and the process including the step of introducing a purging gas substantially free of free oxygen to the top of the retort before resuming the normal retorting operation.

88. In a process as defined in claim 86 the further improvement wherein pressure in the in situ retort during enrichment operation is maintained below ambient pressure in adjacent underground workings.

89. In a process as defined in claim 86 the further improvement comprising the steps of:

conveying at least a portion of the enriched off gas from the top of the in situ retort to another in situ oil shale retort containing a fragmented permeable mass of particles containing unretorted oil shale; and burning the conveyed enriched off gas at the retort containing a fragmented mass of particles containing unretorted oil shale for establishing a heated zone therein.

90. A process for recovering enriched off gas from an in situ oil shale retort in a subterranean formation containing oil shale, the retort containing a fragmented permeable mass of formation particles containing oil shale comprising the steps of:

establishing a heated zone in an upper portion of the fragmented mass, the heated zone having a temperature higher than the retorting temperature of oil shale;

for a first period of normal retorting operation introducing an inlet gas to an upper portion of the fragmented mass on the trailing side of the heated zone for advancing the heated zone through the fragmented mass for retorting oil shale to produce liquid and gaseous products and withdrawing such liquid products and off gas including such gaseous products from a lower portion of the in situ retort; and thereafter for a second period of enrichment operation substantially closing the lower portion of the in situ retort and withdrawing from the upper portion of the retort an enriched off gas comprising gaseous products from retorting oil shale; and thereafter resuming introduction of an inlet gas to an upper portion of the fragmented mass on the trailing side of the heated zone and advancing the heated zone through the fragmented mass.

91. A process as defined in claim 90 wherein enriched off gas withdrawn from the upper portion of the retort during enrichment operation has a heating value of at least about 75 BTU/SCF.

92. A process as defined in claim 90 wherein enriched off gas withdrawn from the upper portion of the retort during enrichment operation has a heating value of at least about 150 BTU/SCF.

93. A process as defined in claim 92 further comprising the steps of:

conveying at least a portion of the enriched off gas from the top of the in situ retort to the top of another in situ oil shale retort containing a fragmented permeable mass of particles containing unretorted oil shale; and burning the conveyed enriched off gas at the top of the retort containing a fragmented mass of particles containing unretorted oil shale for establishing a heated zone therein.

94. A process as defined in claim 90 wherein during the resumed normal retorting operation an oxygen containing gas is introduced to the top of the retort, and the process including the step of introducing a purging gas substantially free of free oxgyen to the top of the retort before resuming the normal retorting operation.

95. A process as defined in claim 90 wherein pressure in the in situ retort during enrichment operation is maintained below ambient pressure in adjacent underground workings.

96. In a process for recovering carbonaceous values from unretorted oil shale in an in situ oil shale retort containing a fragmented permeable mass of particles containing oil shale after retorting a substantial portion of the fragmented mass in said in situ oil shale retort by a method which includes establishing a combustion zone in the fragmented permeable mass and introducing oxygen-containing inlet gas downwardly into said in situ oil shale retort at a sufficient flow rate for retorting particles containing oil shale to produce liquid and gaseous products and retorted particles containing residual carbonaceous material and to advance the combustion zone toward the bottom of said in situ oil shale retort; the improvement comprising during a period of enrichment operation:

introducing oxygen-containing inlet gas downwardly into said in situ oil shale retort at a rate substantially below the rate of downward introduction of oxygen-containing inlet gas into said retort during retorting and sufficient to maintain combustion in said in situ oil shale retort for producing gaseous products from retorting oil shale at the lower portion of the retort, and withdrawing sufficient gas including gaseous products from the bottom of the in situ oil shale retort to reduce the pressure at the bottom of the in situ oil shale retort to less than ambient pressure in adjacent underground workings, wherein gas is introduced at a rate such that the gas withdrawn from the bottom of the retort during enrichment operation has a heating value of at least about 75 BTU/SCF; and thereafter resuming introduction of oxygen-containing inlet gas downwardly into said in situ oil shale retort at a sufficient flow rate for retorting particles containing oil shale.

97. A process as defined in claim 96 including the step of introducing a purging gas substantially free of free oxygen downwardly into said in situ oil shale retort before resuming introduction of oxygen-containing inlet gas into said in situ oil shale retort.

98. In a process for recovering liquid and gaseous products from a fragmented permeable mass of formation particles containing oil shale in an in situ oil shale retort in a subterranean formation containing oil shale wherein during normal retorting operation a processing gas is introduced to the retort and an off gas is withdrawn from the retort for advancing a retorting zone through the fragmented permeable mass of formation particles containing oil shale in the retort, the improvement in enrichment operation comprising the steps of terminating introduction of gas to the in situ retort and withdrawing an enriched off gas including gaseous products from retorting oil shale from the in situ retort, and after said enrichment operation, resuming normal retorting operation.

99. A process as defined in claim 98 wherein enriched off gas is withdrawn from the in situ retort from the same end of the retort as gas was introduced during normal retorting operation.

100. A process as defined in claim 98 wherein the enriched off gas has a heating value of at least about 150 BTU/SCF.

101. A process for recovering enriched off gas from an in situ oil shale retort in a subterranean formation containing oil shale, the retort containing a fragmented permeable mass of formation particles containing oil shale comprising the steps of:

establishing a heated zone in a portion of the fragmented mass, the heated zone having a temperature higher than the retorting temperature of oil shale;

for a period of normal retorting operation introducing an inlet gas to the fragmented mass on a trailing side of the heated zone for advancing the heated zone through the fragmented mass for retorting oil shale to produce liquid and gaseous products and withdrawing such liquid products and off gas including such gaseous products from the in situ retort on an advancing side of the heated zone; and thereafter for a period of enrichment operation substantially completely stopping introduction of inlet gas to the in situ retort and withdrawing from the retort an enriched off gas comprising gaseous products from retorting oil shale; and thereafter resuming introduction of inlet gas to the in situ retort.

102. A process as defined in claim 101 wherein enriched off gas withdrawn from the retort during enrichment operation has a heating value of at least about 75 BTU/SCF.

103. A process as defined in claim 101 wherein enriched off gas withdrawn from the retort during enrichment operation has a heating value of at least about 150 BTU/SCF.

104. A process as defined in claims 49, 62, 63, 68, 69, 74, 86, 91, 92, 100, 102 or 103 including the steps of introducing at least a portion of the enriched off gas to another in situ oil shale retort containing a fragmented permeable mass of particles containing unretorted oil shale, the other in situ oil shale retort having a primary combustion zone advancing therethrough, and burning at least a portion of the enriched off gas in a secondary combustion zone on a trailing side of the primary combustion zone in the other in situ retort.

* * * * *

UNITED STATES PATENT AND TRADEMARK OFFICE

CERTIFICATE OF CORRECTION

PATENT NO. : 4,263,970

DATED : April 28, 1981

INVENTOR(S) : Chang Yul Cha

It is certified that error appears in the above—identified patent and that said Letters Patent is hereby corrected as shown below:

Column 1, line 40, "maristone" should be -- marlstone --.
Column 7, line 46, "my" should be -- may --.
Column 11, line 68, "of" (first occurrence) should be -- or --.
Column 13, line 15, "of" (first occurrence) should be -- or --.
Column 14, line 16, "That" should the -- The --.
Column 16, line 48, "in" should be -- is --;
Column 16, line 59, "relativelyslow" should be -- relatively slow --.
Column 17, line 36, -- operation -- should be inserted after "enrichment" and before "can".
Column 23, line 36, "partially" should be -- partly --;
Column 23, line 64, insert -- the -- before "self-ignition".
Column 25, line 66, "glow" should be -- flow --.
Column 30, line 16, "efore" should be -- before --.
Column 34, line 20, "and" should be -- for --.

Signed and Sealed this

*Eleventh* Day of *August 1981*

[SEAL]

*Attest:*

GERALD J. MOSSINGHOFF

*Attesting Officer*

*Commissioner of Patents and Trademarks*